US009392885B2

(12) United States Patent
Vogler et al.

(10) Patent No.: US 9,392,885 B2
(45) Date of Patent: Jul. 19, 2016

(54) MODULAR MANUAL LIFT DISPENSER SECURITY SYSTEMS AND METHODS FOR ASSEMBLING, MANUFACTURING AND/OR UTILIZING SAID SECURITY SYSTEMS

(71) Applicant: Marketing Impact Limited, Concord (CA)

(72) Inventors: Michael Vogler, Concord (CA); Joel Pollock, Concord (CA)

(73) Assignee: Marketing Impact Limited, Concord, Ontario (CA)

( * ) Notice: Subject to any disclaimer, the term of this patent is extended or adjusted under 35 U.S.C. 154(b) by 0 days.

(21) Appl. No.: 14/493,501

(22) Filed: Sep. 23, 2014

(65) Prior Publication Data

US 2015/0083744 A1 Mar. 26, 2015

Related U.S. Application Data

(60) Provisional application No. 61/881,799, filed on Sep. 24, 2013.

(51) Int. Cl.
*A47F 5/08* (2006.01)
*A47F 1/12* (2006.01)

(52) U.S. Cl.
CPC ..... *A47F 1/126* (2013.01); *A47F 5/0823* (2013.01)

(58) Field of Classification Search
CPC ..... B65D 85/62; B65D 5/725; A24F 27/00; A47F 1/08
See application file for complete search history.

(56) References Cited

U.S. PATENT DOCUMENTS 3,224,822 A * 12/1965 Kirby ..... A47F 1/126 206/503
4,738,384 A * 4/1988 Tigner ..... B65H 35/002 225/16
5,207,784 A * 5/1993 Schwartzendruber .. G07F 9/026 221/14

(Continued)

FOREIGN PATENT DOCUMENTS

FR EP 2550907 A1 * 1/2013

*Primary Examiner* — Leslie A Nicholson, III
*Assistant Examiner* — Ayodeji Ojofeitimi
(74) *Attorney, Agent, or Firm* — Norris McLaughlin & Marcus, P.A.

(57) ABSTRACT

Modular manual lift dispenser security systems and methods store and dispense at least one retail product. The systems and methods have a dispenser body having a floor and walls extending above the floor, wherein the walls of the dispenser body define an interior of the dispenser body that is sized to receive one or more retail products. Further, the systems and methods have a locking lid assembly slidably connected to a top edge of each side wall of the dispenser body via at least one fastener and a pusher paddle located within the interior of the dispenser body, wherein the pusher paddle is spring-loaded and configured to move one or more retail products towards the front wall of the dispenser body. Still further, the systems and methods have a first opening between a lip of the front wall of the dispenser body and a front edge of the locking lid assembly that is located adjacent to the front wall of the dispenser body, wherein the first opening is sized such that a leading retail product is passable through the opening between the lip of the front wall and the front edge of the locking lid assembly. Moreover, the systems and methods have a recess formed in the floor of the dispenser body and a lift slot formed in the front wall of the dispenser body, wherein the recess and lift slot are at least one of sized and shaped such that a leading retail product is accessible through the recess and lift slot.

11 Claims, 15 Drawing Sheets

(56) References Cited

U.S. PATENT DOCUMENTS 8,646,621 B2 * 2/2014 Zacherle ..... A47F 1/126
206/526

2006/0037484 A1 * 2/2006 Dixon ..... A47J 47/01
99/426

2011/0121011 A1 * 5/2011 Gelardi ..... A47F 1/08
221/30

* cited by examiner

MODULAR MANUAL LIFT DISPENSER SECURITY SYSTEMS AND METHODS FOR ASSEMBLING, MANUFACTURING AND/OR UTILIZING SAID SECURITY SYSTEMS

CROSS REFERENCE TO RELATED APPLICATION

This application claims the benefit of U.S. Provisional Patent Application No. 61/881,799, filed Sep. 24, 2013, the entirety of which is hereby incorporated by reference into this application.

FIELD OF THE DISCLOSURE

The present systems and methods provide one or more modular manual lift dispenser security systems that are usable for securing, storing, dispensing, lifting, housing and/or receiving one or more retail products, consumer products and/or commercial products. The present systems and methods may securely store and dispense one or more of the retail, consumer and/or commercial products which may be offered for sale to one or more consumers.

BACKGROUND OF THE DISCLOSURE

Theft of items in retail stores is a major concern for retailers. Items that are often the target of shoplifters include over-the-counter (hereinafter "OTC") products such as analgesics and cough and cold medications, razor blades, camera film, batteries, videos, DVDs, smoking cessation products and infant formula. For a number of reasons, preventing theft of these products is a priority for retailers. Retailers desire shelving, security devices or other apparatus that deters theft of these OTC products while granting access or, at least, limited access to legitimate customers.

Theft has become particularly problematic for certain product categories, such as, for example, razors and/or infant formula. Many retail stores are taking these products off the shelves and placing them behind the counter or under lock and key. While effective in preventing theft of these products, such measures present a new set of problems. Specifically, customers may be deterred by having to request the product in order to make a purchase. Further, such a procedure requires that the clerk or cashier interrupt their usual duties in order to comply with a request. Finally, available space for such shelving may be limited.

The present systems and methods provide effective theft deterrence of retail and/or OTC products without the drawbacks associated with known systems and methods of deterring tampering and/or theft.

SUMMARY OF THE DISCLOSURE

In embodiments, a modular manual lift dispenser security system may store and dispensing at least one retail product. The system may have a dispenser body having a floor and walls extending above the floor, wherein the walls comprise a front wall and a back wall facing each other and at least two side walls facing each other, wherein the walls of the dispenser body define an interior of the dispenser body that is sized to receive one or more retail products. The system may also have a locking lid assembly slidably connected to a top edge of each side wall of the dispenser body via at least one fastener, wherein the top edge of each side wall is located opposite with respect to the floor of the dispenser body. Further, the system may have a pusher paddle located within the interior of the dispenser body, wherein the pusher paddle is spring-loaded and configured to move one or more retail products towards the front wall of the dispenser body when the one or more retail products are positioned within the interior of the dispenser body. Still further, the system may have a first opening between a lip of the front wall of the dispenser body and a front edge of the locking lid assembly that is located adjacent to the front wall of the dispenser body, wherein the lip of the front wall is located opposite with respect to the floor of the dispenser body, wherein the first opening is sized such that a leading retail product, adjacent to the front wall of the dispenser body, is passable through the first opening between the lip of the front wall and the front edge of the locking lid assembly from the interior of the dispenser body to an exterior environment when at least the leading product is positioned within the interior of the dispenser body. Moreover, the system may have a recess formed in the floor of the dispenser body and a lift slot formed in the front wall of the dispenser body, wherein the recess and lift slot are at least one of sized and shaped such that a leading retail product, adjacent to the front wall of the dispenser body, is accessible through the recess and lift slot when at least the leading retail product is positioned within the interior of the dispenser body.

In an embodiment, the system may have a second opening, between the lip of the front wall of the dispenser body and the front edge of the locking lid assembly, provided by sliding the locking lid from a first position to a second position.

In an embodiment, the system may have a mounting bracket connected to the back wall of the dispensing body, and a fixture connected to the back wall of the dispensing body via the mounting bracket.

In an embodiment, the system may have a lock assembly provided within the locking lid assembly, and a release key configured to unlock the lock assembly.

In an embodiment, the lock assembly may be a magnetic spring lock assembly and the release key comprises a magnet.

In an embodiment, the system may have an alarm tracking sensor, having a roller arm, positioned within a housing below the floor of the dispenser body.

In an embodiment, the walls of the dispenser body may extend below the floor to define the housing below the floor of the dispenser body.

In an embodiment, the system may have a cover enclosing the alarm tracking sensor and roller arm within the housing below the floor of the dispenser body.

In an embodiment, a first end of the locking lid assembly is hinged to the side walls of the dispenser body via the fasteners such that a second end of the locking lid is pivotable with respect to the dispenser body.

In embodiments, a modular manual lift dispenser security system may store and dispense at least one retail product. The system may have a dispenser body having a floor and walls extending above the floor, wherein the walls comprise a front wall and a back wall facing each other and at least two side walls facing each other, wherein the walls of the dispenser body define an interior of the dispenser body that is sized or shaped to receive one or more retail products. The system may also have a pusher paddle located within the interior of the dispenser body, wherein the pusher paddle is spring-loaded and configured to move one or more retail products towards the front wall of the dispenser body when the one or more retail products are positioned within the interior of the dispenser body. Further, the system may have a locking lid assembly at least connected to a top edge of each side wall of the dispenser body via at least one fastener, wherein the top edge of each side wall is located opposite with respect to the floor of the dispenser body, wherein the locking lid assembly is slidable from a first position to at least one second position. Still further, the system may have a lock assembly provided within the locking lid assembly, wherein the locking lid assembly is slidable from the first position to the second position when the lock assembly is unlocked and further wherein the locking lid assembly is stationary in the first position or second position when the lock assembly is locked. Access to the interior of the dispenser body may be prevented when the locking lid assembly is located in the first position, wherein a first opening is provided between a lip of the front wall of the dispenser body and the front edge of the locking lid assembly when the locking lid assembly is located in the second position, wherein the lip of the front wall is located opposite with respect to the floor of the dispenser, and further wherein the first opening is sized such that a leading retail product, adjacent to the front wall of the dispenser body, is passable through the first opening between the lip of the front wall and the front edge of the locking lid assembly from the interior of the dispenser body to an exterior environment when at least the retail product is positioned within the interior of the dispenser body.

In an embodiment, the system may have a release key for unlocking the lock assembly, wherein release key is at least one of sized and shaped to be inserted into a positioning guide formed on a top surface of the locking lid assembly for unlocking the lock assembly, wherein the top surface of the locking lid is located opposite with respect to the lock assembly.

In an embodiment, the lock assembly may be a magnetic spring lock assembly and the release key may comprise a magnet.

In an embodiment, the lock assembly may comprise slidable lock latches and springs that may force the slidable lock latches outward with respect to side walls of the lock assembly through slots formed in the side walls of the lock assembly.

In an embodiment, the lock latches may extend through the slots of the lock assembly and into catches formed in the side walls of the dispenser body when the lock assembly is locked, and further wherein the lock latches only extend through the slots of the lock assembly when the lock assembly is unlocked.

In an embodiment, the entire length of the lock latches may be positioned within the lock assembly when a release key, comprising a magnet, is positioned on a top surface of the lock assembly between the side walls of the lock assembly.

In embodiments, a modular manual lift dispenser security system stores and dispenses at least one retail product. The system may have a dispenser body having a floor and walls extending above and below the floor, wherein the walls comprise a front wall and a back wall facing each other and at least two side walls facing each other, wherein the walls of the dispenser body define an interior of the dispenser body that is sized or shaped to receive one or more retail products. The system may also have a locking lid assembly slidably connected to a top edge of each side wall of the dispenser body via at least one fastener, wherein the top edge of each side wall is located opposite with respect to the floor of the dispenser body. Further, the system may have a pusher paddle located within the interior of the dispenser body, wherein the pusher paddle is spring-loaded and configured to move one or more retail products towards the front wall of the dispenser body when the one or more retail products are positioned within the interior of the dispenser body. Still further, the system may have an alarm sensor body, having a roller arm, connected to the pusher paddle and located within a housing below the floor of the dispenser body, wherein the housing below the floor is defined by the walls extending below the floor of the dispenser body, wherein movement of the pusher paddle activates the alarm sensor body and an alert is produced.

In an embodiment, the system may have a cover connected to the housing such that the alarm sensor is enclosed between the floor, the housing and the cover.

In an embodiment, the system may have a contact track provided below the floor of the dispenser body and extending between at least a portion of the length of the dispenser body defined between the front wall and back wall of the dispenser body, wherein the alarm sensor body is movable along a profile of the contact track.

In an embodiment, the roller arm may contact the contact track and follow the profile of the contact track as the alarm sensor body and pusher paddle move along the length of the dispenser body.

In an embodiment, the profile of the contact track may be an undulating wave.

BRIEF DESCRIPTION OF THE DRAWINGS

So that the features and advantages of the present disclosure can be understood in detail, a more particular description of the present systems and methods may be had by reference to the embodiments thereof that are illustrated in the appended drawings. It is to be noted, however, that the appended drawings illustrate only some embodiments of the present systems and methods and are therefore not to be considered limiting of its scope, for the present systems and methods may admit to other equally effective embodiments.

DETAILED DESCRIPTION OF THE DISCLOSURE

Figure 1:
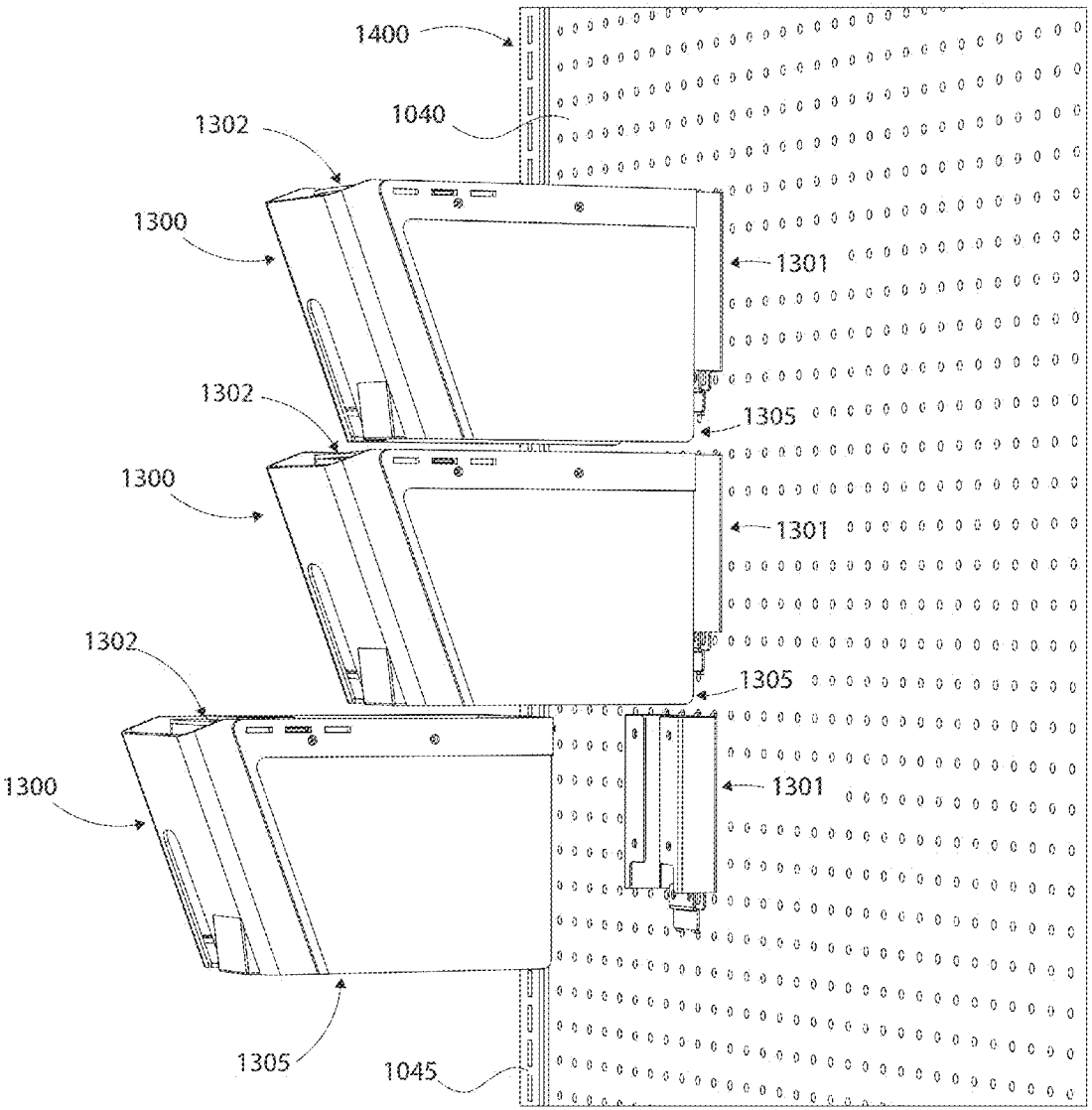
FIG. 1 illustrates a perspective view of a plurality of modular manual lift dispenser security cases connected a fixture in an embodiment.

The present disclosure is directed to modular manual lift dispenser security systems and methods for assembling, manufacturing and/or utilizing said security systems. The present systems and methods may secure, store, dispense, house and/or receive one or more products. Referring now to the drawings wherein like numerals refer to like parts, the present systems and methods provide at least one modular lift dispenser security case 1300 (hereinafter "case 1300") as shown in FIGS. 1-4, FIGS. 7A-7C, 8A-8C, 9-11, 12A-12C and 14. The case 1300 is sized, shaped, configured and/or adapted to secure, store, protect, house and/or dispense at least one first retail product 1600 (hereinafter "first product 1600"), at least one second retail product 1601 (hereinafter "second product 1601") and/or at least one third product 1602 (hereinafter "third product 1602") as shown in FIGS. 7A-7C, 8A-8C and 11. The first product 1600, the second product 1601 and/or the third product 1602 (collectively known hereinafter as "products 1600, 1601, 1602") may be or may comprise or include, for example, consumer products, food products, hard goods, durable goods, soft goods, consumables, consumer-grade goods, professional-grade goods and the like. In an embodiment, the products 1600, 1601, 1602 may be at least one or more over-the-counter retail products (hereinafter "OTC products") which may include analgesics, medications, pharmaceuticals, razors, razor blades, camera films, batteries, videos, DVDs, smoking cessation products, infant formula, vitamins, personal care products, home care products, toothbrushes, foodstuffs, packaged foods, kitchen supplies, bags, boxes, containers and/or the like. Moreover, the products 1600, 1601, 1602 usable with the present systems and methods may be any retail products known to one of ordinary skill in the art that are configured, adapted, sized and/or shaped to be located, stored, housed and/or positioned within or inside the case 1300.

The products 1600, 1601, 1602 may located or stored within and/or positioned inside the case 1300 which may be located inside, for example, a marketplace and/or a retail establishment. The marketplace and/or the retail establishment may be, for example, a chain store, a department store, a discount store, a grocery store, a hardware store, a health food store, a liquor store, a warehouse store, a variety store, a specialty store, a general store, a convenience store, a toy store, a pet store, an outlet store, a supermarket, a mall and/or the like. In embodiments, the case 1300 may be associated with and/or incorporated into, for example, a vending machine, a portable sales device, a point of sale terminal and/or an automated retail store. The products 1600, 1601, 1602 may be accessible singly or one at a time through a front-side of the case 1300 as shown in FIGS. 8A-8C and 12A-12C. In embodiments, the products 1600, 1601, 1602 may be accessible in combination or more than one at a time through the front-side of the case 1300. The products 1600, 1601, 1602 which may be utilized with the case 1300 may be a same type of retail products, different types of retail products and/or a combination of same and different types of retail products. In embodiments, the products 1600, 1601, 1602 may have different sizes and/or different shapes of packaging. The present disclosure should not be deemed as limited to a specific embodiment of the marketplace and/or the retail establishment wherein the case 1300 may be located, included and/or incorporated.

Figure 14:
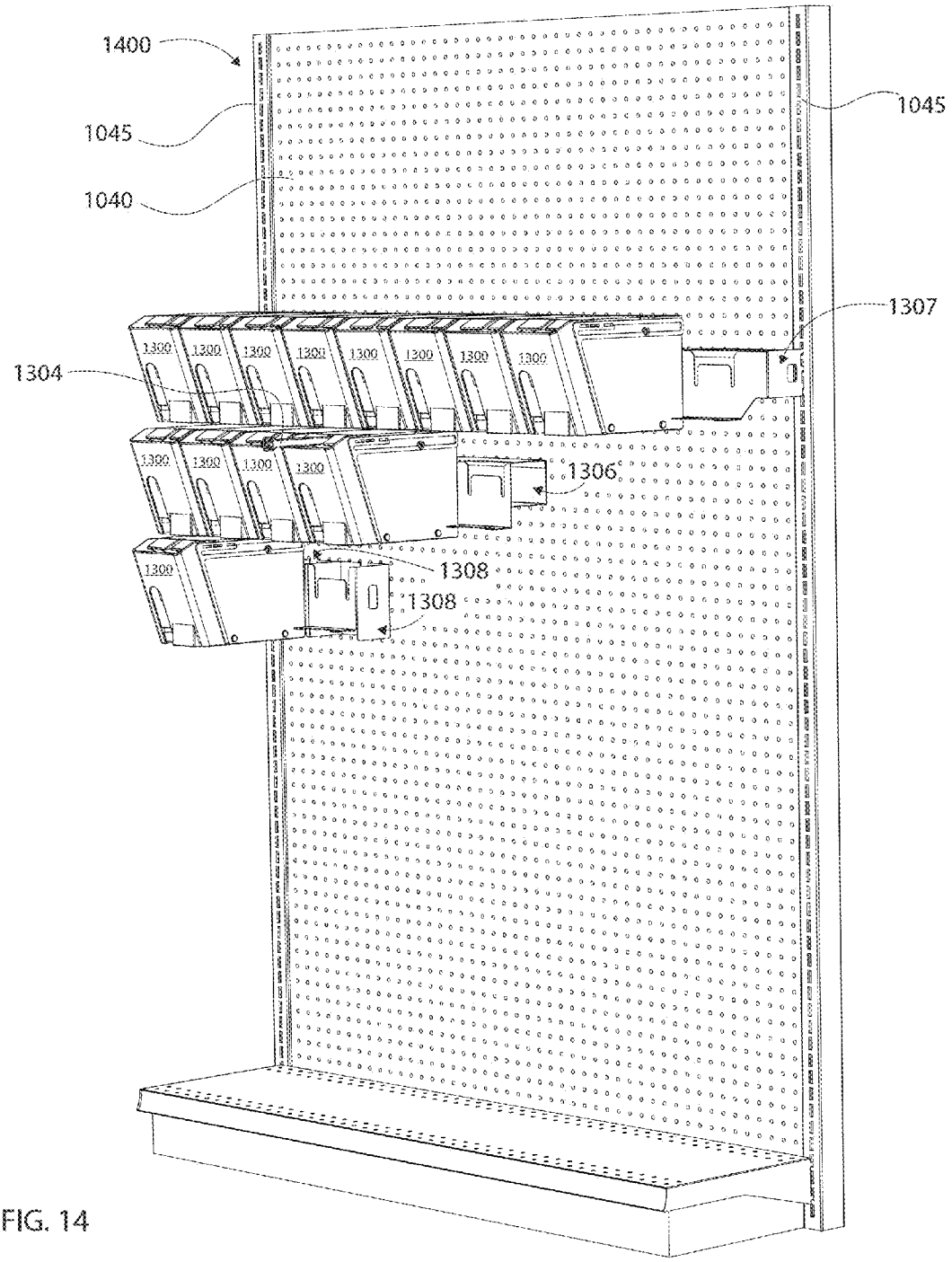
FIG. 14 illustrates a perspective view of a plurality of modular manual lift dispenser security cases connected to a fixture via a plurality of mounting brackets in an embodiment.

FIG. 1 shows a vertical positioning of a plurality of cases 1300 connected to a first fixture 1040 (hereinafter "first fixture 1040") and/or a second fixture 1400 (hereinafter "second fixture 1400") via a plurality of mounting bracket assemblies 1301 (hereinafter "bracket assemblies 1301"). As a result, the bracket assemblies 1301 may attach, affix, mount and/or secure the plurality of cases 1300 to the first fixture 1040 and/or the second fixture 1400 (collectively known hereinafter as "fixtures 1040, 1400"). In embodiments, the fixtures 1040, 1400 may be stationary or movable and/or may comprise of supportive elements, such as, for example, walls, uprights, rods, shafts, pegboards, shelves or the like. In embodiments, the first fixture 1040 may be an aisle pegboard and the second fixture 1400 may be an aisle gondola section. In an embodiment, the second fixture 1400 may be typical forty-eight inch aisle gondola section. It should be understood that the present disclosure is not limited to a specific embodiment of the fixtures 1040, 1400. In embodiments, the plurality of cases 1300 may be connected, attached, fastened, secured and joined to one or more third fixtures 1045, which may be or may comprise one or more uprights as shown in FIG. 14. The fixtures 1040, 1400 and/or the one or more third fixtures 1045 (collectively known hereinafter as "fixtures 1040, 1400, 1045") may be known fixtures typically utilized in retail spaces and/or environments.

Figure 2:
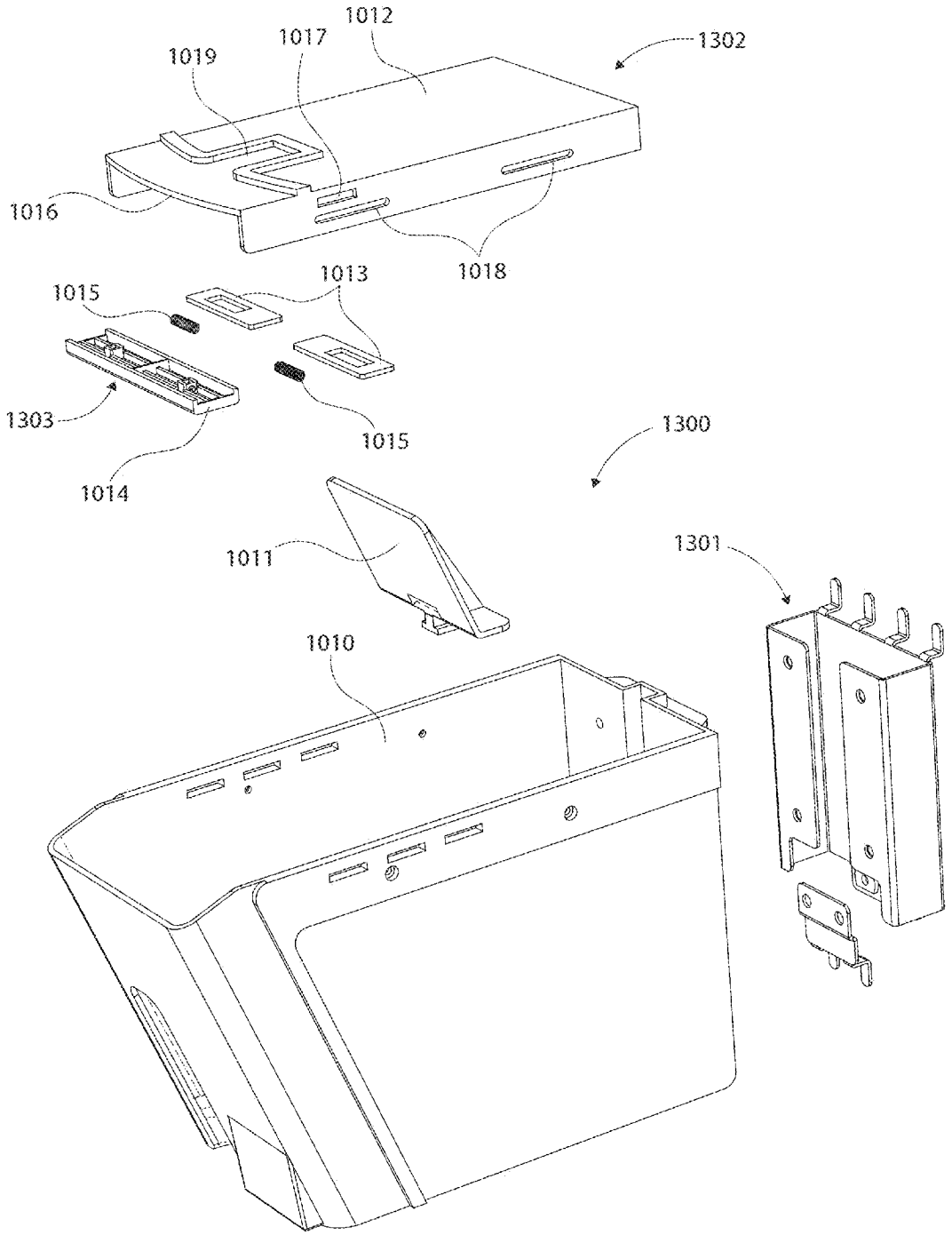
FIG. 2 illustrates an exploded perspective view of a modular manual lift dispenser security case and components of the security case in an embodiment.
Figure 4:
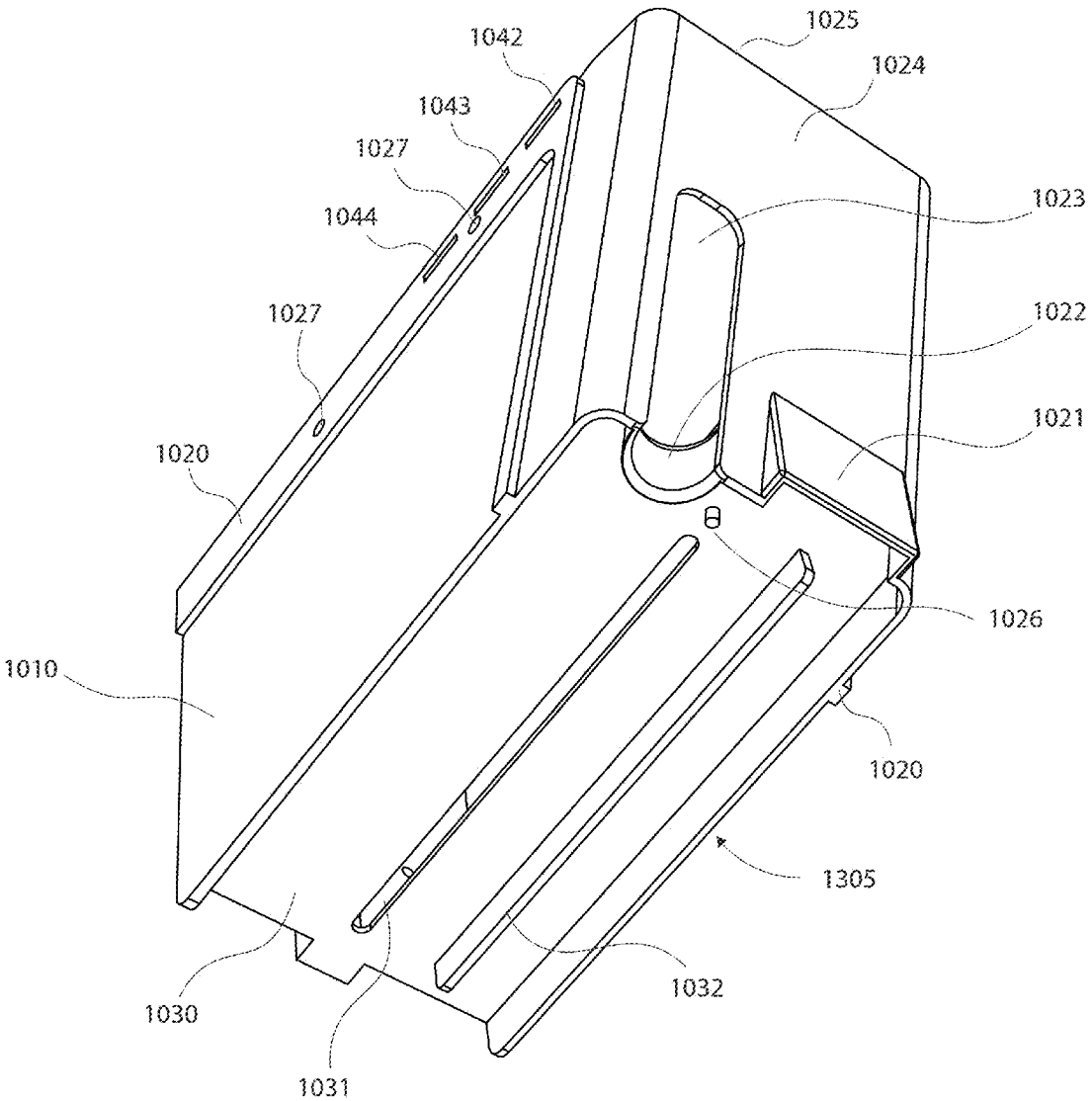
FIG. 4 illustrates a perspective view of the underside of the dispenser body shown in FIG. 3 in an embodiment.
Figure 6B:
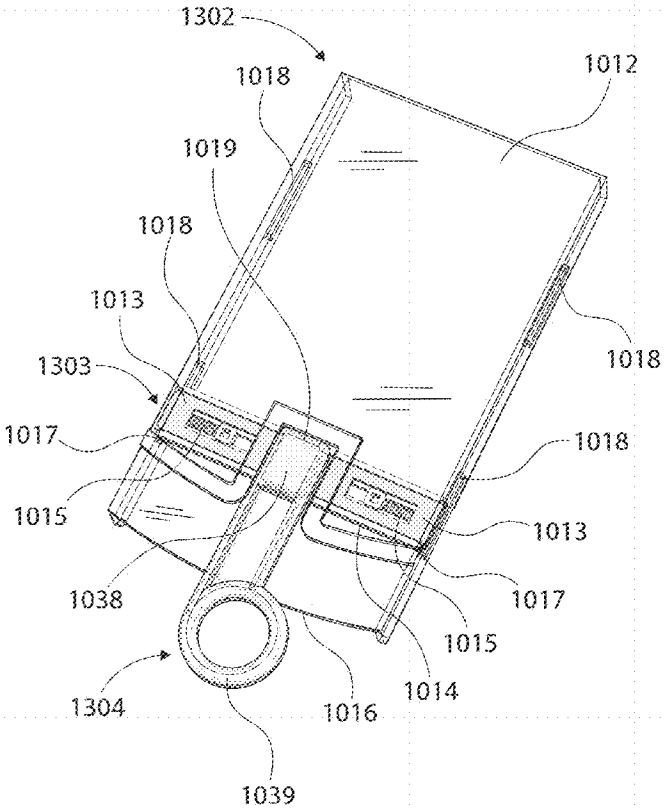
FIGS. 6A and 6B illustrate a top plan view of a multi-positional locking lid assembly in a locked position and an unlocked position, respectively, in an embodiment.
Figure 6A:
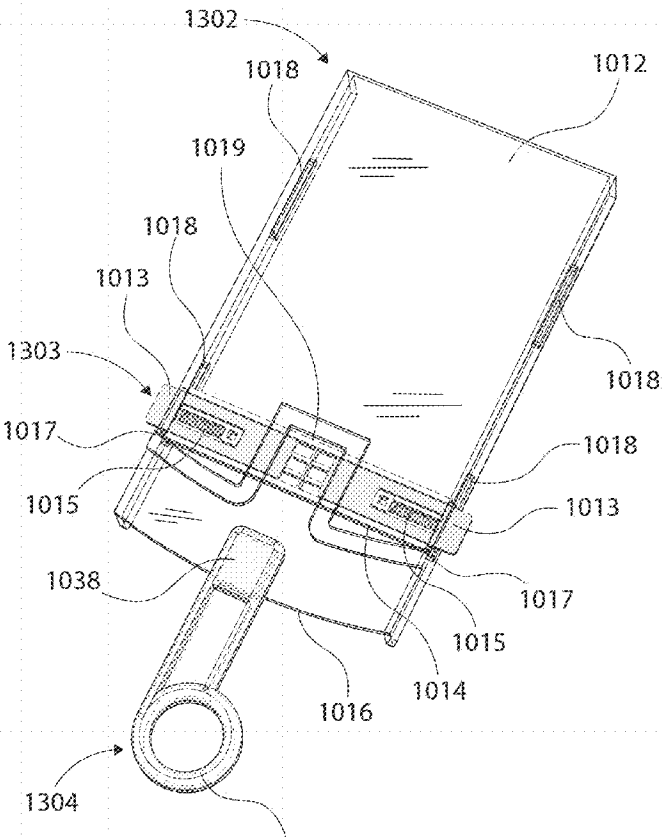

Each case 1300 may be positioned, placed and/or located within a close vertical proximity of adjacent cases 1300 that may be located above and below one another for reducing unauthorized access to components of the vertically adjacent cases 1300. As a result, an overall amount of merchandising space required within the second fixture 1400 may be minimized. Some components of the cases 1300 include a multi-positional lid assembly 1302 (hereinafter "lid assembly 1302") and/or lower case components 1305 as shown in FIGS. 2 and 4. FIG. 2 illustrates that the lid assembly 1302 may be a locking multi-positional lid assembly that may contain and/or house a magnetic lock assembly 1303 (hereinafter "lock assembly 1303"). In embodiments, the lock assembly 1303 may be a magnetic spring lock assembly as shown in FIGS. 6A and 6B.

Figure 3:
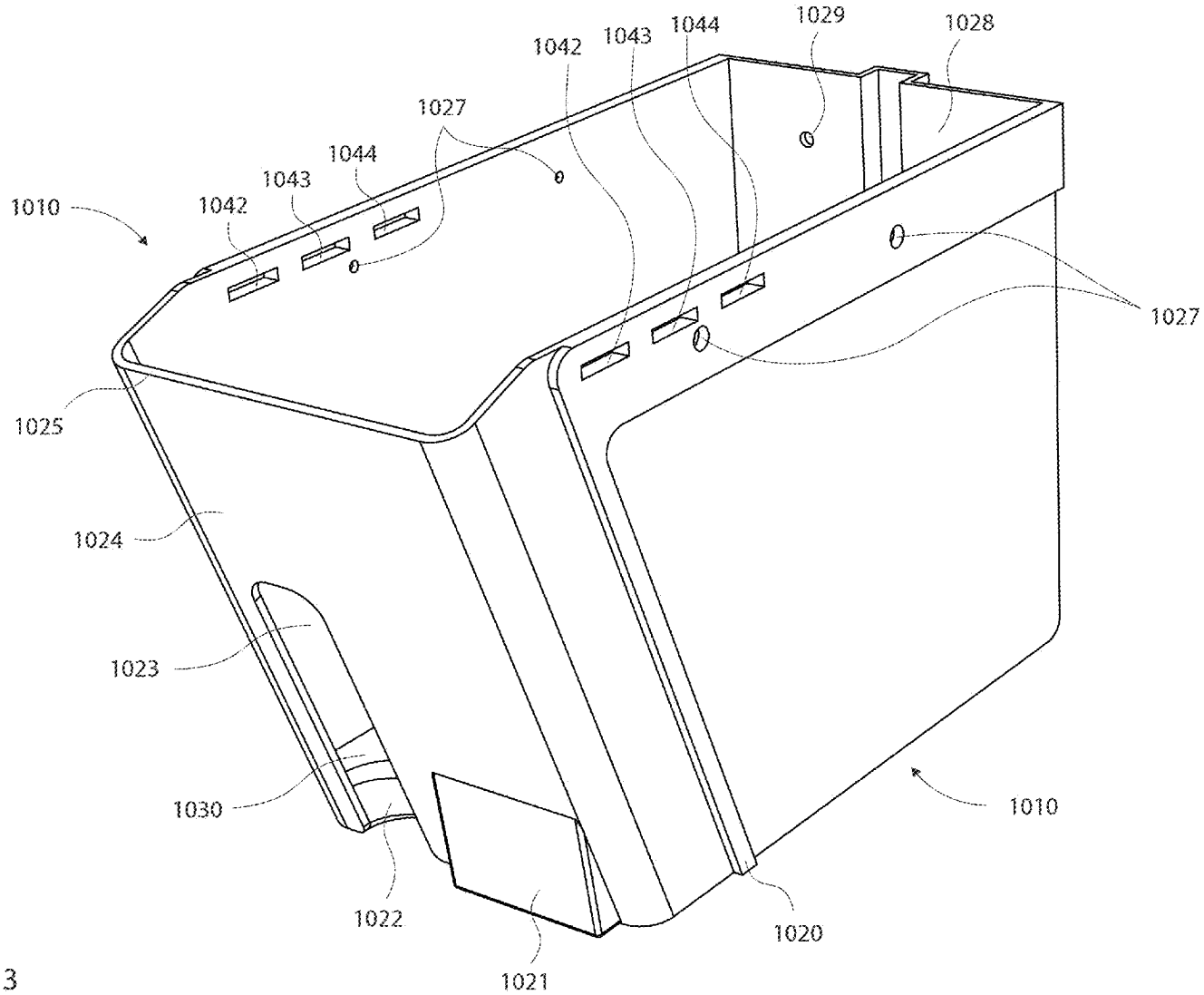
FIG. 3 illustrates a perspective view of a dispenser body of a modular manual lift dispenser security case in an embodiment.

As shown in FIG. 2, components of, or associated with, each case 1300 may include the bracket assembly 1301, the lid assembly 1302, a main moulded dispenser body 1010 (hereinafter "dispenser body 1010") and/or pusher paddle 1011 for applying forward tension or force onto the products 1600, 1601, 1602 to move, push and/or pull the products 1600, 1601, 1602 towards a front display window 1024 (hereinafter "display window 1024") of the dispenser body 1010 as shown in FIG. 3. As shown in FIGS. 7A-7C and 8A-8C, one or more of the products 1600, 1601, 1602 are positioned and/or located between the pusher paddle 1011 and the display window 1024. In embodiments, the product 1600 is adjacent to the pusher paddle 1011, the product 1602 is adjacent to the display window 1024 and/or the product 1601 is located between the product 1600 and the product 1602. As a result, when the products 1600, 1601, 1602 are dispensed or removed from the case 1300, the product 1602 is dispensed first, followed by the product 1601 which is further followed by the product 1600.

Figure 8A:
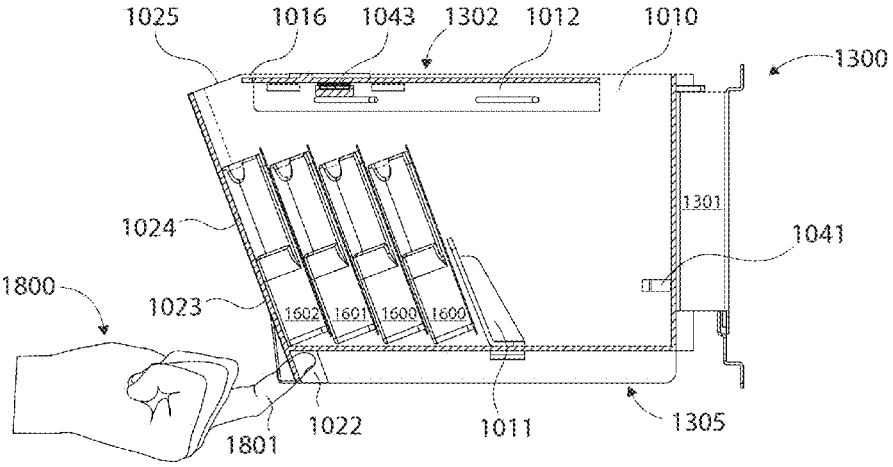
FIGS. 8A-8C illustrate cross-sectional views of a modular manual lift dispenser security case dispensing a product positioned in first, second and third positions, respectively, in an embodiment.
Figure 8B:
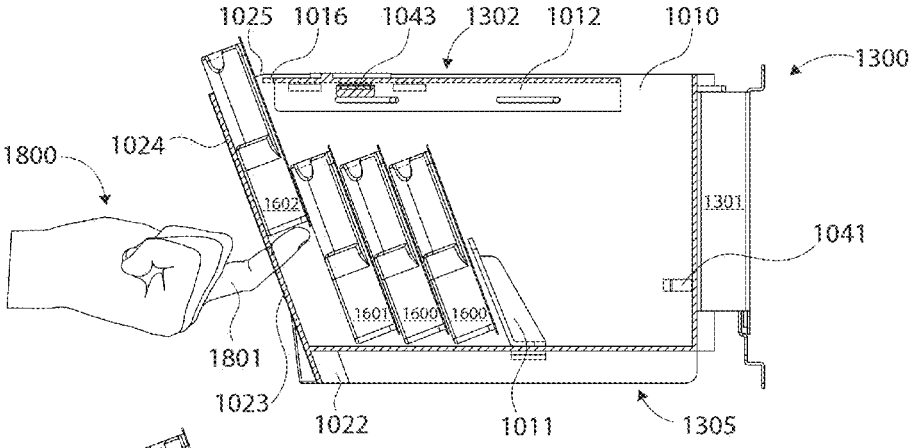
Figure 8C:
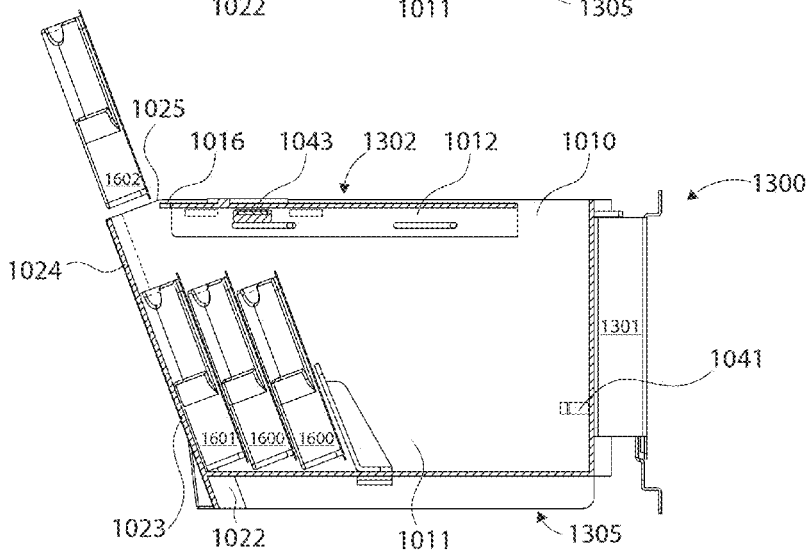
Figure 9:
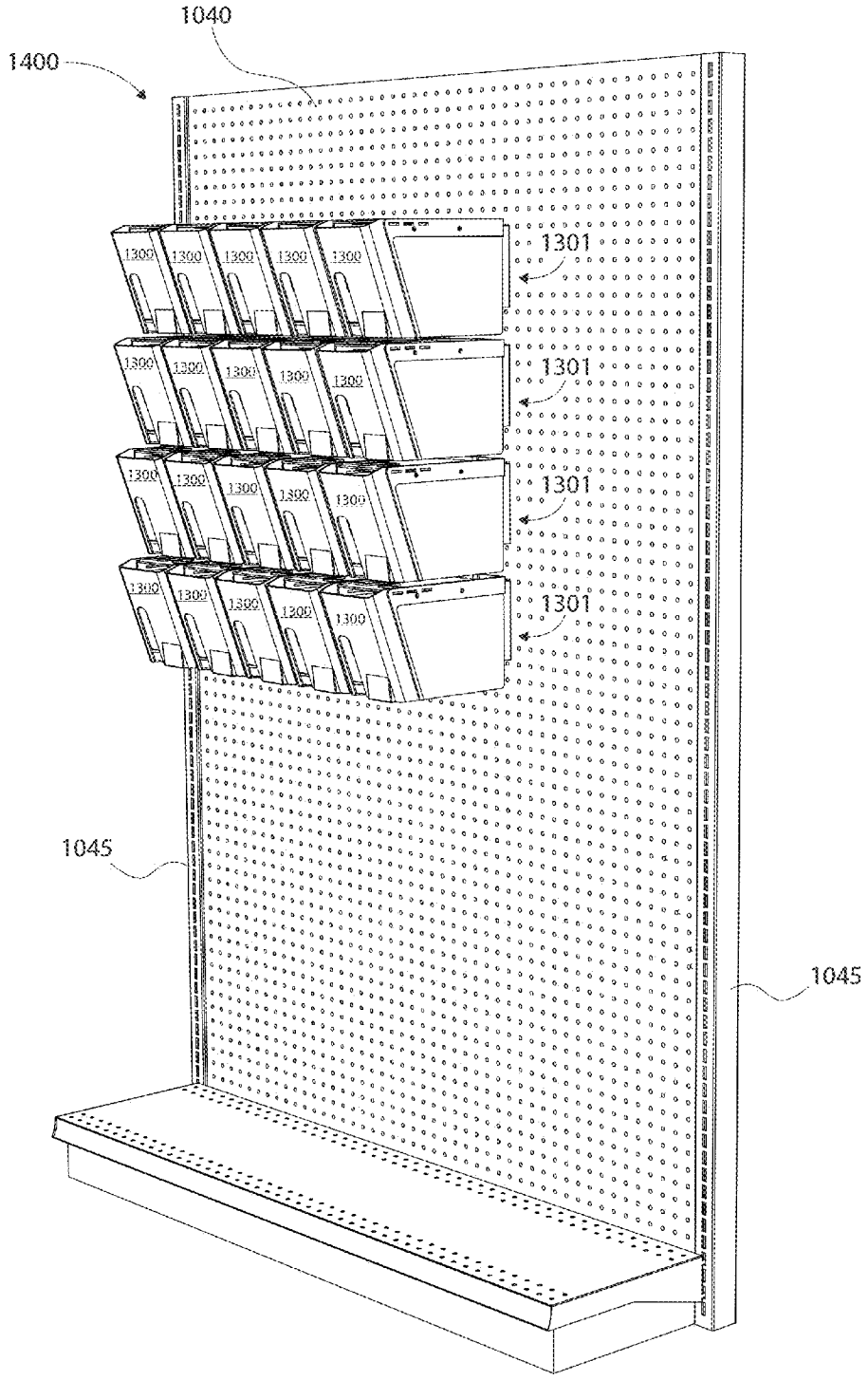
FIG. 9 illustrates a perspective view of a plurality of modular manual lift dispenser security cases connected to a fixture in an embodiment.

In embodiments, the display window 1024 may be made of a clear or transparent plastic and/or polymer material such that a leading product, such as, for example, the product 1602 may be visible or viewable through the display window 1024. The display window 1024 may also be angled forward, at a first angle, which may ensures that a product removal lip 1025 (hereinafter "removal lip 1025") of the dispenser body 1010 remains unobstructed when in close proximity of a vertically adjacent case 1300 as shown in FIGS. 1 and 9. The forward angle of the display window 1024 at the first angle may maintain full frontal visibility of the leading or third product 1602 as shown in FIGS. 7A-7C and 8A-8C when the case 1300 may be mounted, connected and/or attached to the fixtures 1040, 1400, 1045. In embodiments, the pusher paddle 1011 may be spring loaded to provide forward tension and/or force to the products 1600, 1601, 1602. In embodiments, the pusher paddle 1011 may be angled forward at a second angle that may be greater than, equal to, substantially equal to or less than the first angle of the display window 1024. In an embodiment, the pusher paddle 1011 may be angle forward such that a face of the pusher paddle 1011 may be parallel or substantially parallel to the face of the display window 1024 as shown in FIGS. 8A-8C As shown in FIGS. 3 and 4, the dispenser body 1010 may comprise, have and/or include one or more side security barriers 1020 (hereinafter "security barriers 1020"), at least one graphic mounting surface 1021, at least one package access recess 1022 (hereinafter "access recess 1022"), at least product lift slot 1023 (hereinafter "lift slot 1023"), the display window 1024, the removal lip 1025, one or more hardware connection holes 1027 (hereinafter "connection holes 1027"), at least one rear mounting plate 1028 (hereinafter "mounting plate 1028"), one or more attachment bracket mounting holes 1029 (hereinafter "mounting holes 1029"), at least one dispenser body floor 1030 (hereinafter "floor 1030") one or more first lock catches 1042 (hereinafter "first catches 1042"), one or more second lock catches 1043 (hereinafter "second catches 1043") and/or one or more third lock catches 1044 (hereinafter "1044"). In an embodiment, at least one first catch 1042, at least one second catch 1043 and at least one third catch 1044 are provided on both sides of the dispenser body 1010 or on side walls of the dispenser body 1010 that are located opposite with respect to each other, wherein the side walls extend outwardly away from the floor 1030 of the dispenser body 1010.

As shown in FIG. 4, the lower case components 1305 of the dispenser body 1010 may comprise, have and/or include at least one pusher spring connection 1026 (hereinafter "spring connection 1026"), at least one pusher paddle guide track 1031 (hereinafter "guide track 1031") and/or at least one accessory and/or contact track 1032 (hereinafter "contact track 1032") for one or more optional alarm sensors. In an embodiment, the dispenser body 1010 may be a single premolded piece and/or the security barriers 1020, the graphic mounting surface 1021, the access recess 1022, the lift slot 1023, the display window 1024, the removal lip 1025, the spring connection 1026, the connection holes 1027, the mounting plate 1028, the mounting holes 1029, the floor 1030, guide track 1031, the contact track 1031, the first catches 1042, the second catches 1045 and/or the third catches 1044 may be integrally formed in and/or on the dispenser body 1010.

In embodiments, security barriers 1020 are sized, shaped, configured and/or adapted to protect or cover the first catches 1042, the second catches 1043, the third catches 1044 and/or mounting slots 1018 of the lid assembly 1302. The graphic mounting surface 1021 may provide a surface for displaying information and/or indicia associated with the products 1600, 1601, 1602, such as, for example, a name, a manufacture, a trademark, an expiration date, a provider, a ticket price or the like. The access recess 1022 may be position and/or situated below the dispenser body floor 1030 to allow at least one finger of a user 1800 to make contact with or access to at least one portion of product 1602 and/or to lift the product 1602 out of the case 1300 via the opening between the lift slot 1023 and/or the removal lip 1025. It should be understood that the present disclosure should not be deemed as limited to a specific embodiment of the information and/or indicia associated with the products 1600, 1601, 1602 which may be displayed on the graphic mounting surface 1021.

In embodiments, the connection holes 1027 may connect, attach, affix, fasten and/or join a slidable locking multi-position lid 1012 (hereinafter "locking lid 1012") of the lid assembly 1302 to the dispenser body 1010 though the mounting slots 1018 of the lid assembly 1032. The mounting plate 1028 of the dispenser case 1010 may connect, attach, join, fasten and/or mount to a mounting bracket body 1034 (hereinafter "bracket body 1034") of the bracket assembly 1302 through the mounting holes 1029 of the dispensing body 1010 and/or mounting holes 1033 of the bracket assembly 1032. The first catch 1042 may hold, secure and/or maintain the locking lid 1012 in the closed position, which may prevent or substantially prevent one or more of the product 1602, 1601, 1600 from being removed from the case 1300. As a result, the products 1600, 1601, 1600 may not be removed or dispensed from the case 1300 when the locking lid 1012 is held, secured and/or maintained in the closed position via the first catch 1042. The second catches 1043 may hold, secure and/or maintain the locking lid 1012 in a first open position which may create or provide a first opening between removal lip 1025 and a front edge 1016 of locking lid 1012. In an embodiment, the first opening may be large or wide enough for the removal of the leading product or product 1602 from the front side of case 1300, when the product 1602 is a package having a small or medium depth. As a result, the leading or third product 1602 may be removable or dispensable via the first opening when the leading or third product 1602 is a package having a small or medium depth. In embodiments, a package having a small or medium depth may have a depth range from about 0.5 inches to about 1.15 inches, from about 0.625 inches to about 1 inch or from about 0.75 inches to about 1.25 inches. In an embodiment, the product having a small or medium package depth may be a standard razor cartridge package. However, the size and/or shape of the first opening may be configured and/or adapted to allow other types of retail products or packages to be dispensed from the case 1300.

In embodiments, the third catches 1044 may hold, secure and/or maintain locking lid 1012 in a second open position creating a second opening between removal lid 1025 and the front edge 1016 of the locking lid 1012. In an embodiment, the second opening may be large or wide enough for the removal of the leading product or product 1602 from the front side of the case 1300, when the product 1602 is a package having a large depth. As a result, the leading product or product 1602 may be removable or dispensable via the second opening when the leading product or product 1602 is a package having a large depth. In embodiments, a package having a large depth may have a depth range from about 1.25 inches to about 3 inches or from about 1.5 inches to about 2.25 inches. The width of the first and second openings is determined on the basis that the width of the opening between the front edge 1016 of the locking lid 1012 and the removal lip 1025 is small enough to cover about half the depth of the second product 1601 located rearward from the third product 1602. As a result, the third product 1602 may be dispensed and the second product 1601 is prevented from being dispensed at the same time as the third product 1602. In embodiments, all of the products 1600, 1601, 1602 within the case 1300 have the same or substantially the same thickness or depth.

Figure 5:
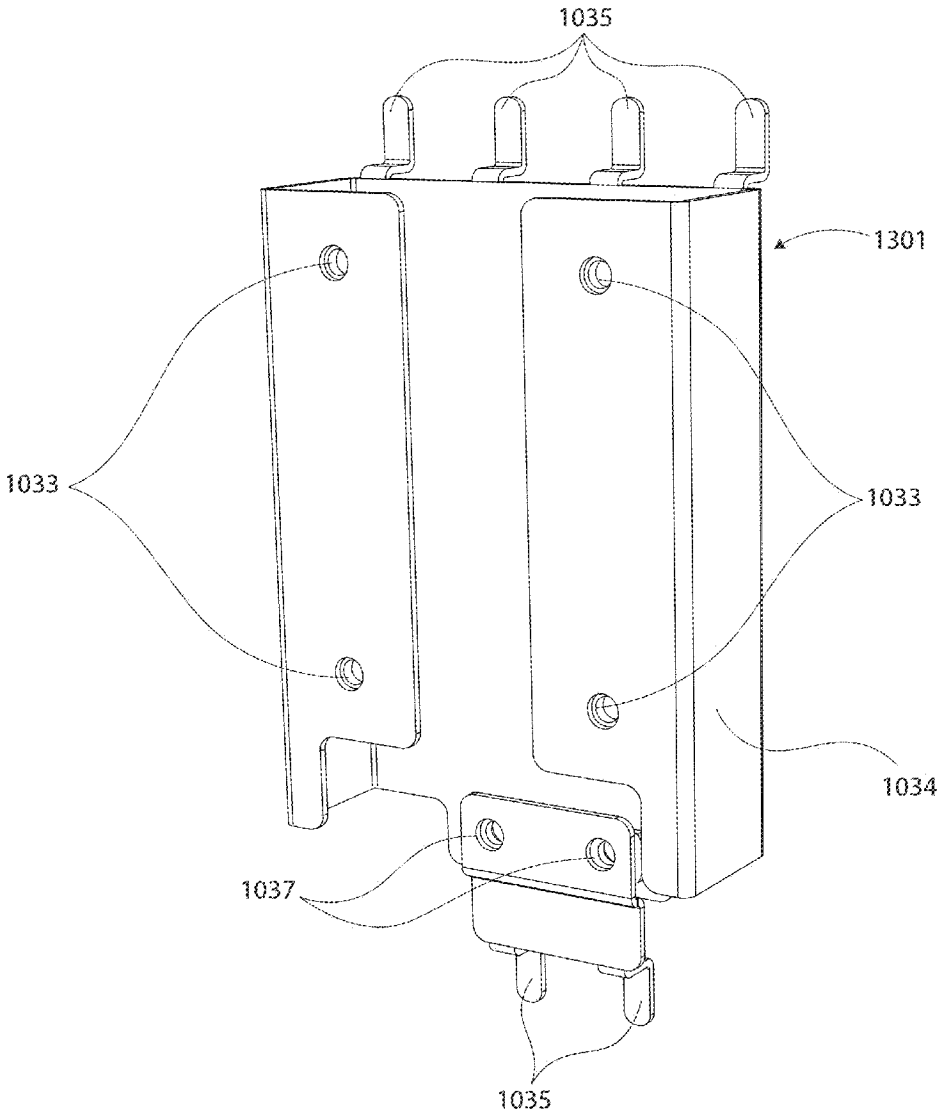
FIG. 5 illustrates a perspective view of a mounting bracket assembly for connecting a dispenser body of a modular manual lift dispenser security case to a fixture in an embodiment.

As shown in FIG. 5, the mounting assembly 1301 may comprise, have and/or include the mounting holes 1033, the bracket body 1034, one or more hooks 1035 (hereinafter "hooks 1035") and/or one or more lock clips 1037 (hereinafter "lock clips 1037"). In an embodiment, the mounting assembly 1301 may be a single pre-molded piece and/or the mounting holes 1033, the hooks 135 and/or the clips 1037 may be integrally formed with the bracket body 1034. In an embodiment, one or more of the mounting holes 1033, the bracket body 1034, the hooks 1035 and/or the lock clips 1037 may be made of a metal, such as, steel, iron or the like. In embodiments, the depth of bracket body 1034 may be changeable or adjustable to accommodate the overall depth of case 1300 which may aid in maintaining consistency with a depth of surrounding fixtures.

The mounting holes 1033 may be sized, shaped, configured and/or adapted to facilitate connecting, attaching and/or mounting the mounting assembly 1301 to the dispensing body 1010 through the mounting plate 1028. The bracket body 1034 may be sized, shaped, configured and/or adapted to have a necessary depth that is based on a required depth of the case 1300. The hooks 1035 may connect, attach, secure and/or mount the bracket assembly 1301 to the fixtures 1040, 1400, 1045. As a result, the dispensing body 1010 of the case 1300 may be connected, attached, secured and/or mounted to the fixtures 1040, 1400, 1045 via the hooks 1035 of the bracket assembly 1301. In an embodiment, the hooks 1035 may be pegboard hooks for securely attaching the mounting assembly 1301 to, for example, a vertical pegboard. In an embodiment, the locking clips 1037 may be one or more pegboard lock clips which may be connectable and/or attachable to one or more lock clip mounting holes 1036. In an embodiment, the mounting holes 1036 may be threaded holes to retain the locking hardware, such as, for example a fastener 154, used to fasten the dispensing body 1010 to the locking clips 1037 to prevent or substantially prevent removal of the case 1300 from the fixtures 1040, 1400, 1045. The locking hardware, described throughout the present disclosure, may include at least one of pins, pegs, screws, nuts and bolts, rods, tabs, nails, clips and fasteners.

As shown in FIG. 2, the lid assembly 1302 may comprise, have and/or include the locking lid 1012 and the lock assembly 1303, which may be a magnetic spring lock assembly. The locking lid 1012 may comprise, have and/or include a front edge 1016, at least one guide slots 1017 (hereinafter "guide slots 1017"), at least two mounting slots 1018 (hereinafter "mounting slots 1018") and/or at least one positioning guide 1019 (hereinafter "positioning guide 1019") that is positioned on a top side of the locking lid 1012. In an embodiment, the locking lid 1012 may be a single pre-molded piece and the front edge 1016, the guide slots 1017, the mounting slots 1018 and/or the positioning guide 1019 may be integrally formed in and/or on the locking lid 1012.

Figure 10:
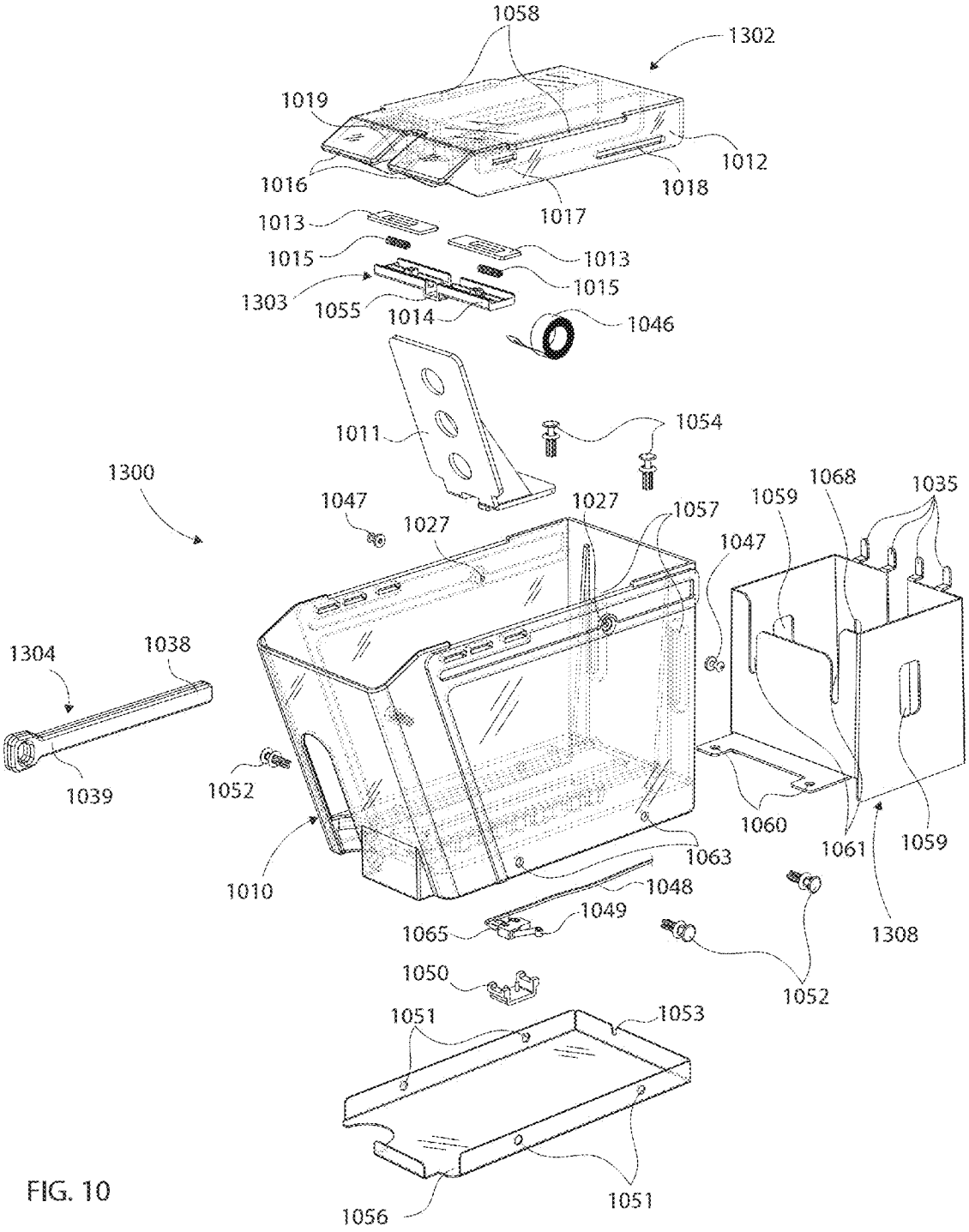
FIG. 10 illustrates an exploded perspective view of a modular manual lift dispenser security case and components of the security case in an embodiment.

In embodiments, the guide slots 1017 may be sized, shaped, configured and/or adapted to receive slidable lock latches or cams 1013 (hereinafter "lock cams 1013") of the lock assembly 1303. The mounting slots 1018 of the locking lid 1012 and the mounting holes 1027 of the dispenser body 1010 are sized, shaped, configured and/or adapted to receive at least one mounting hardware or fastener 1047 (hereinafter "fastener 1047") as shown in FIG. 10. As a result, the locking lid 1012 and the dispenser body 1010 may be connected, attached, affixed, secured, fastened and/or joined together via the fastener 1047, the mounting slots 1018 and/or the mounting holes 1027. Further, an interior of the dispensing body 1010 is enclosed, sealed and/or surrounded when the locking lid 1012 and the dispenser body 1010 are connected, attached, affixed, secured, fastened and/or joined together. Moreover, horizontal movement of the locking lid 1012 is allowed, controlled and/or limited by inserting or positioning the fasteners 1047 into the mounting slots 1018 and mounting holes 1027. At least a portion of the positioning guide 1019 may be sized, shaped, configured and/or adapted for receiving a least a portion of a lock release key 1304 as shown in FIGS. 6A and 6B As shown in FIG. 2, the lock assembly 1303 may comprise, have and/or include the lock cams 1013, at least one lock containment body 1014 (hereinafter "containment body 1014") and/or at least two springs 1015 (hereinafter "springs 1015"). In an embodiment, the lock cams 1013 may be made of a metal material and/or may be slidable within the containment body 1014. The springs 1015 may be mounted in the containment body 1014 such that spring force from the springs 1015 move, maintain and/or force the lock cams 1013 outwardly with respect to outer ends of the containment body 1014, wherein the length of the containment body 1014 is defined between the outer ends of the containment body 1014.

FIG. 4 shows the underside of dispenser body 1010 and the lower case component housing 1305. The side walls of dispenser body 1010 may extend downwardly past or below the floor 1030 of the dispensing body 1010. The side walls may enclose, secure, protect and/or hide alarm and/or pusher components, present on the underside of the dispenser body 1010 and/or floor 1030 within housing. As a result, the alarm and/or pusher components may be protected from being tampering with, disabled, removed, destroyed and/or damaged. For example, as shown in FIG. 1 wherein a plurality of cases 1300 are mounted in close vertical proximity, the lower case component housing 1305 of the lowest case 1300 is left exposed. As a result, a security cover 1056 (as shown in FIG. 10) may be connected, attached and/or affixed to said lower case component housing 1305 to protect alarm and/or pusher components present on the underside of the lowest case 1300. The security cover 1056 may be made of plastic or polymer material(s), metal material(s) or a combination thereof.

FIGS. 6A and 6B illustrate a process of unlocking the lock assembly 1303 that is connected, attached, affixed and/or joined to or inserted into a bottom side of the locking lid 1012, whereby the bottom side of the locking lid 1012 is located opposite with respect to the top side having the positioning guide 1019. As shown in FIG. 6A, the lock assembly 1303 is attached to the bottom side of the locking lid such that the slidable lock cams 1013 extend outwardly away from the springs 1015 and through the guide slots 1017 of the locking lid 1012. As a result, the lock assembly 1303 and the locking lid 1012 may be connected, attached and/or joined together via the lock cams 1013, the guide slots 1017 and/or other fastening device located on the bottom side of the locking lid 1012.

FIG. 6A shows the lock release key 1304, having a magnet 1038 provided at one end of a molded release key body 1039, located adjacent to the lock assembly 1303 but not engaging the lock assembly. The lock assembly 1303 may be unlocked with the release key 1304 for (i) loading, reloading, replenishing and/or removing one or more of the products 1600, 1601, 1602 stored or housed within the case 1300 and/or (ii) changing or moving the position of the locking lid 1012 through the use of the first, second and third catches 1042, 1043, 1044 of the dispenser body 1010 as shown in FIG. 3. As a result of changing or moving the position of the locking lid 1012, an opening between the front edge 1016 of the locking lid 1012 and product removal lip 1025 of the dispenser body 1010 may be moved or changed to provide the first open or the second opening which may accommodate the depth of the products 1600, 1601, 1602 within the dispensing body 1010.

Further, FIG. 6A shows the release key 1304 positioned above the top side of lid assembly 1302 with the magnet 1038 positioned in front of the positioning guide 1019. As a result, the lock latches 1013 may be held in or forced into an extended position within the lock containment body 1014 under pressure from or force exerted by the lock springs 1015. In FIG. 6B, the release key 1304 is moved forward such that the magnet 1038 of the release key 1304 may be centered inside a slot of the positioning guide 1019 and/or against the top side of the locking lid 1012. In an embodiment, the magnet 138 of the release key 1304 is positioned between side walls of the locking lid 1012 wherein a width of the locking lid 1012 is defined between the side walls of the locking lid 1012. With the magnet 1038 positioned inside the positioning guide and on the top side of the locking lid 1012, the magnet forces of the magnet 1038 pull, force or retract the springs 1015 and/or the lock cams 1013 inwardly and/or towards the center of the containment body 1014. Further, the lock cams 1013 may be pulled out of or refracted from the first, second or third catches 1042, 1043, 1044 on the dispenser body 1010 and/or from the guide slots 1017 of the locking lid 1012. As a result, the lock assembly 1303 may be unlocked or opened and/or the lid assembly 1302 may be free to slide, or capable of being slid, horizontally on the fasteners 1054 connected through the connection holes 1027 of the dispenser body 1011 traversing the mounting slots 1018 of the locking lid 1012 as shown in FIGS. 3 and 7A-7C. When the release key 1304 is removed, lock springs 1015 force or move the lock cams 1013 back into the default position extending outwardly and away from locking lid 1012 through the guide slot 1017 of the locking lid 1012 as shown in FIG. 6A.

Figure 7A:
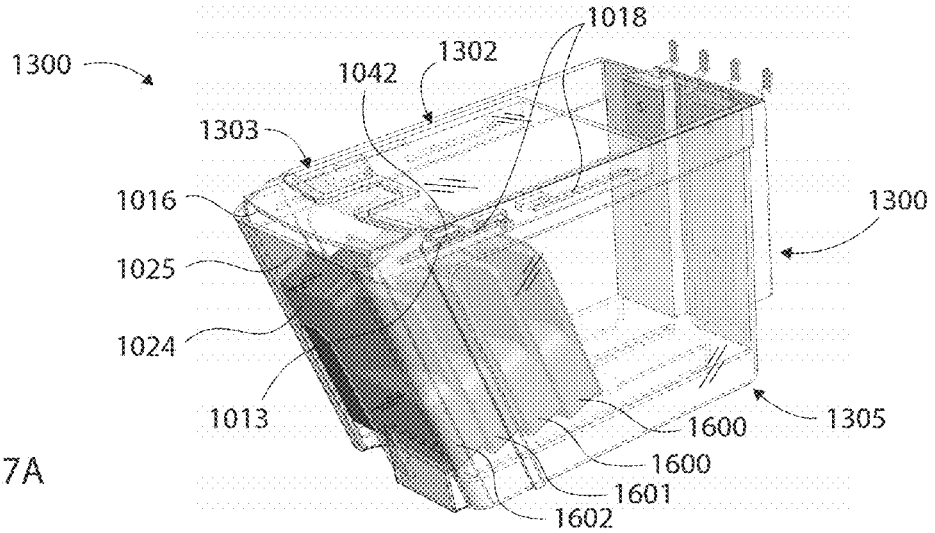
FIGS. 7A-7C illustrate perspective views of a modular manual lift dispenser security case having a lid assembly secured in first, second and third positions, respectively, to a dispenser body in an embodiment.
Figure 7B:
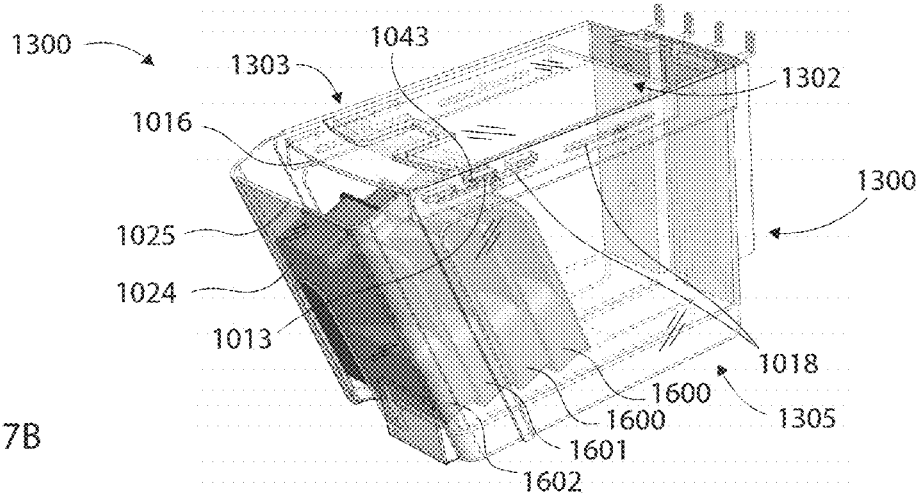
Figure 7C:
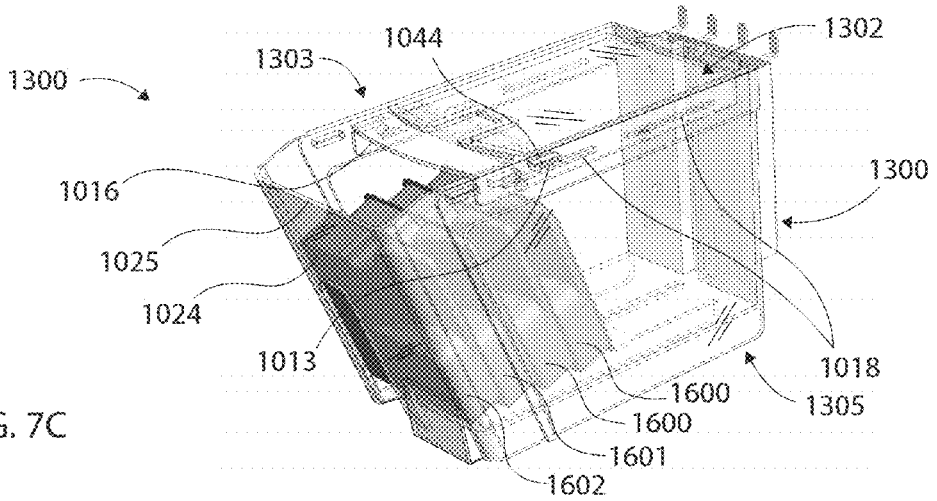

FIGS. 7A-7C illustrate the lid assembly 1302 connected, attached and/or secured in various positions with respect to the dispenser body 1010 by way or use of the lock assembly 1303 and/or first, second and third catches 1042, 1043, 1044. The cases 1300 are not limited to the specific configurations shown in FIGS. 7A-7C, customized positions and configurations of the catches 1042, 1043 and 1044 may be determined by and/or based on one or more dimensions of the products being dispensed from the cases 1300.

FIG. 7A shows the case 1300 having the lid assembly 1302 in an absolute forward or first position (hereinafter "first position") with the lock cams 1013 of the lock assembly 1303 in a locked position within the lock catches 1042. In the first position, space between the front edge 1016 of the locking lid 1012 and the product removal lip 1025 of the dispensing body 1010 is not large enough for the removal of the product 1602 from the case 1300. As a result, the products 1600, 1601, 1602 are secured between the dispensing body 1010 and locking lid 1012 or within the interior of the dispenser body 1010 when the lid assembly is located or positioned in the first position.

FIG. 7B shows the lid assembly 1302 in an intermediary or second position (hereinafter "second position") with the lock cams 1013 of lock assembly 1303 in a locked position within the second catches 1043. In the second position, the first opening between the front edge 1016 of the locking lid 1012 and the product removal lip 1025 is provided or formed to allow, or is large enough that, the product 1602, a single small to medium depth package, to pass or move between the front edge 1016 and the removal lip 1025 while preventing access to first and second products 1600, 1601 located rearward with respect to the third product 1602. As a result, the third product 1602 may be removed or dispensed from the case 1300 via the first opening and the first and second products 1600, 1601 may remain securely housed within the case 1300 and/or between the dispenser body 1010 and the lid assembly 1302 or the interior of the dispenser body 1010.

FIG. 7C shows the lid assembly 1302 in an absolute back or third position (hereinafter "third position") with the lock cams 1013 of the lock assembly 1303 in a locked position within the third lock catches 1044. In the third position, the second opening between the front edge 1016 of the locking lid 1012 and the removal lip 1025 is provided or formed to allow the product 1602, a single large depth package, to pass or move between the front edge 1016 and the removal lip 1025 while preventing access to the first and second products 1600, 1601. As a result, the third product 1602 may be removed or dispensed from the case 1300 via the second opening while the products 1600, 1601 remain securely housed within the interior of the case 1300. Further, the second opening is greater than or substantially greater and/or has a larger width than the first opening between the front edge 1016 and the removal lip 1025. Moreover, the third position of the lid assembly 1302 may also be utilized to provide additionally access to the products 1600, 1601, 1602 for the purposes of reloading, restocking or removing.

FIGS. 8A-8C illustrate a process of dispensing the product 1602 from a front side of the case 1300. The case 1300 is configured with the lid assembly 1302 locked in the second position using the second catches 1043 creating the first opening with sufficient space for removal of the products 1602, 1601, 1600 one at a time. The products 1602, 1601, 1600 are held under forward tension against clear display window 1024 by way of the pusher paddle 1011.

FIG. 8A shows a hand 1800 of a user preparing to dispense third product 1602. One of more fingers 1801 of the hand 1800 is placed within the access recess 1022 formed in the dispenser body 1010 below the leading or third product 1602. FIG. 8B shows the one or more finger 1801 of the hand 1800 lifting, moving, pushing and/or pulling upwardly and the one or more finger 1801 lifting, moving, pushing and/or pulling the leading or third product 1602 in an upward motion against the display window 1024 while traversing product lift slot 1023 formed in the display window 1024. The product 1602 is pushed through the first opening created between the product removal lip 1025 and the front edge 1016. As the one or more fingers 1801 reach the top of the product removal slot 1023, a bottom portion of the leading or third product 1602 approaches the first opening between the removal lip 1025 and the front edge 1016. In FIG. 8C, the hand 1800 is removed from the product lift slot 1023 and the user removes the product 1602 from above the case 1300. As product 1602 leaves or is dispensed from the case 1300, the pusher paddle 1011 forces the first and second products 1600, 1601 forward against the display window 1024 until the second product 1601 rest against, contacts or abuts the display window 1024. An audible alarm motion sensor 1041 (hereinafter "motion sensor 1041") may be associated with the interior of the case 1300 or may be provided on one or more of the inside walls of the case 1300 or below the floor 1030. The motion sensor 1041 may be activated by one or more movements of the pusher paddle 1011 and/or the first and second products 1600, 1601. As a result, the motion sensor 1041 may trigger at least one audible alert that may create awareness within the surrounding environment that the case is be utilized by the users.

FIG. 9 shows a plurality of cases 1300 connected, attached and/or mounted to the first fixture 1040 within the second fixture 1400 via the bracket assembly 1301.

FIG. 10 shows an exploded view of the case 1300 for dispensing and/or securely storing the products 1600, 1601, 1602 in an embodiment. The case 1300 may comprise, have and/or include at least one mounting bracket assembly 1308 (hereinafter "bracket assembly 1308"), the lid assembly 1302, the lock assembly 1303, the pusher paddle 1011, the release key 1304, at least one alarm sensor 1065 (hereinafter "alarm sensor 1065"), the lower case cover 1056, the dispenser body 1010, at least one sensor mounting bracket 1050 (hereinafter "sensor mounting bracket 1050"), a pusher spring 1046, and first locking and mounting hardware or fasteners 1047, second locking mounting hardware or fasteners 1052 and/or third locking and mounting hardware or fasteners 1054 (collectively known hereinafter as "fasteners 1047, 1052, 1054"). In embodiments, the bracket assembly 1308 may have one or more of the same, substantially the same or similar features and/or components as the bracket assembly 1301, and the bracket assembly 1308 may function the same as, substantially the same as or similar to the bracket assembly 1301.

Figure 15:
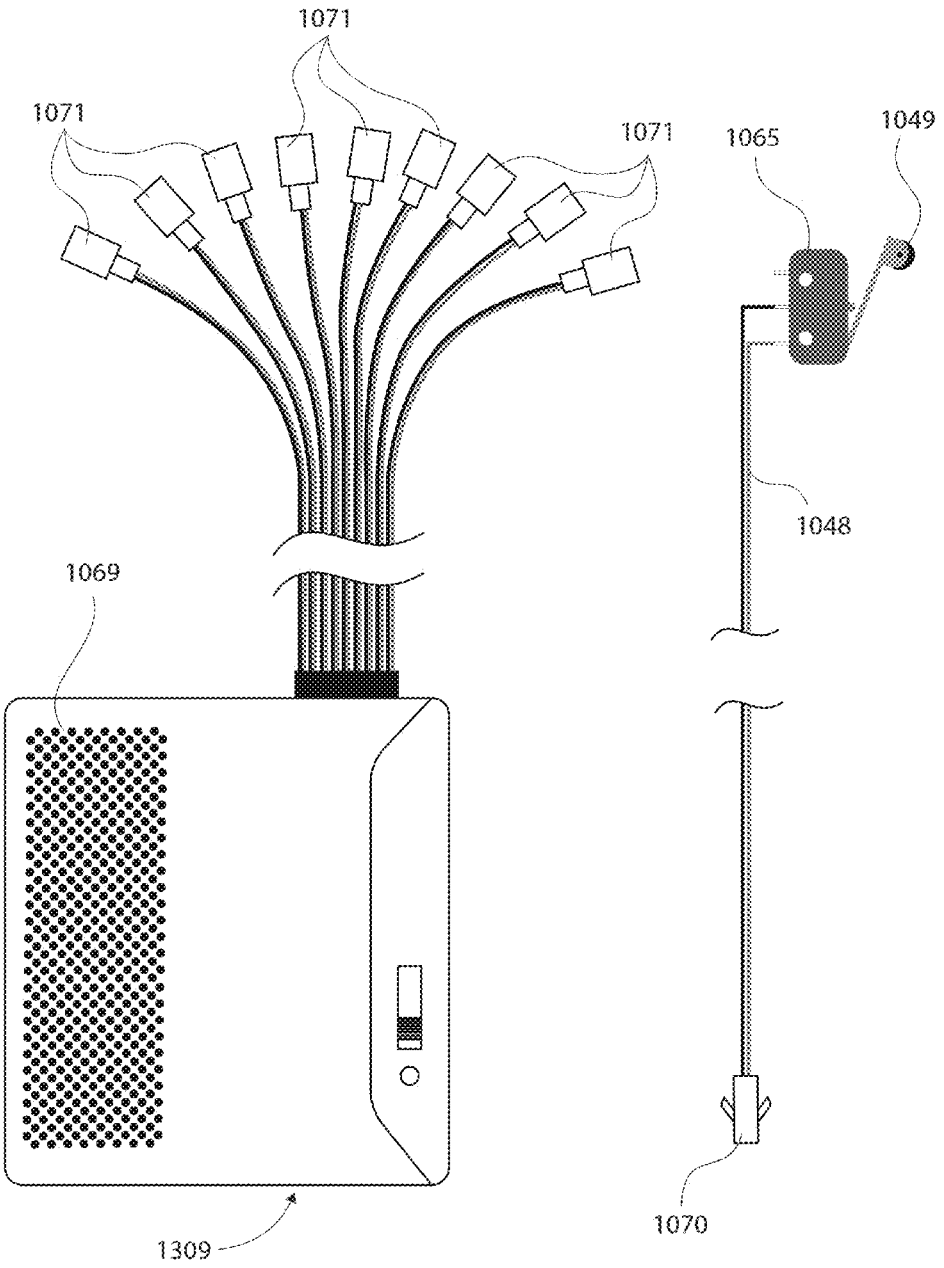
FIG. 15 illustrates an alarm control unit and an alarm sensor for use with a modular manual lift dispenser security case in an embodiment.

In embodiments, the bracket assembly 1308 may comprise, have and/or include the hooks 1035 for connecting or mounting to the fixtures 1040, 1400, 1045, one or more wire lead pass-through openings 1059 (hereinafter "openings 1059") formed in one or more side walls of the bracket assembly 1308, one or more mounting hardware holes 1060 (hereinafter "hardware holes 1060") formed in one or more portions of the bracket assembly 1308, one or more case mounting slots 1061 (hereinafter "mounting slots 1061") formed in one or more side walls of the bracket assembly 1308 and/or one or more fixture lock holes 1068 (hereinafter "lock holes 1068") formed on one or more side walls of the bracket assembly 1308 for connecting and/or mounting the bracket assembly to the fixtures 1040, 1400 and/or to aisle uprights 1045 (hereinafter "uprights 1045") on the second fixture 1400 as shown in FIG. 14. In embodiments, the bracket assembly 1308 may be a single modular bracket having a body depth that may be customizable and/or adjustable for a specific or pre-determined application, environment, surrounding shelves and/or fixtures. In embodiments, the bracket assembly 1308 may be sized, shaped, configured and/or adapted to receive, enclose, protect and/or securely house an alarm unit 1309 as shown in FIG. 15.

Figure 13A:
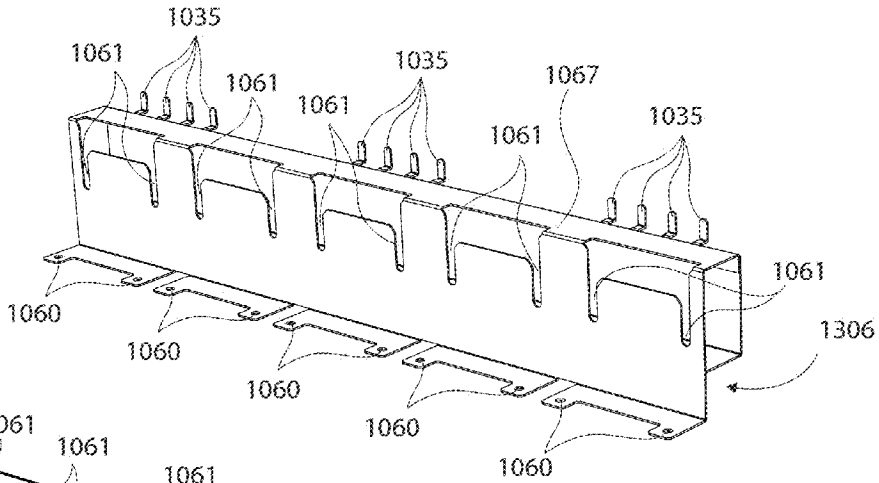
FIGS. 13A and 13B illustrate perspective view of mounting brackets in an embodiment.
Figure 13B:
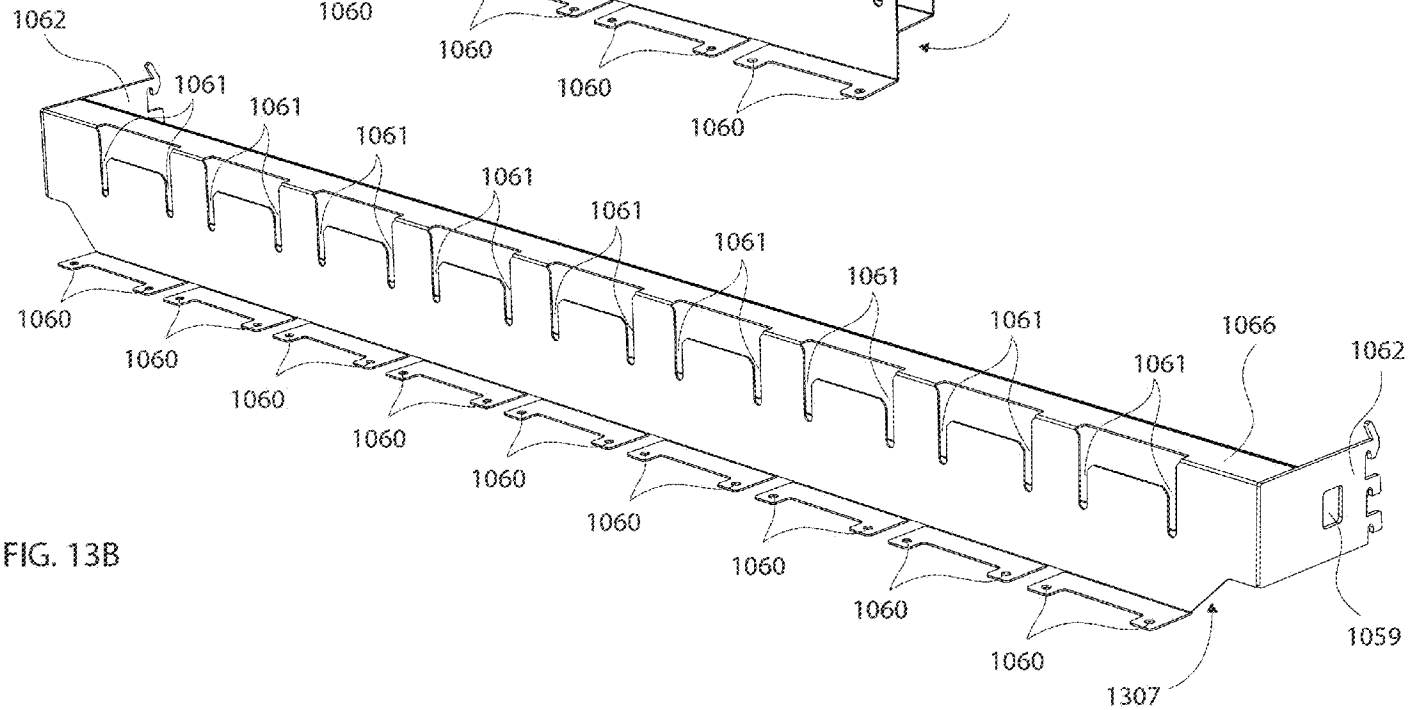

FIGS. 13A, 13B and 14 show a multi-unit mounting bracket 1306 (hereinafter "mounting bracket 1306") and a multi-unit mounting bracket 1307 (hereinafter "mounting bracket 1307") which may have the same, substantially the same or similar features and/or components as the bracket assembly 1308 and/or the bracket assembly 1301, and the mounting brackets 1306, 1307 may function the same as, substantially the same as or similar to the bracket assembly 1308 and/or the bracket assembly 1301. In embodiments, the mounting bracket 1306 may be a multi-unit pegboard mounting bracket that provides the ability to horizontally mount two or more modular cases 1300. In a preferred embodiment, the mounting bracket 1306 may mount a total of five modular cases 1300 horizontally; however, the mounting bracket 1306 may be configured or adapted to mount at least two cases 1300 and no more than ten cases 1300. The mounting bracket 1306 may be sized, shaped, configured and/or adapted to receive, enclose, protect and/or securely house the alarm unit 1309. In embodiments, the mounting bracket 1307 may be a multi-unit upright mounting bracket that provides the ability to horizontally mount a plurality of modular cases 1300 within the second fixture 1400. In embodiments, the mounting bracket 1307 may be connected, attached, secured, mounted and/or joined to the uprights 1045. The mounting bracket 1307 may be sized, shaped, configured and/or adapted to receive, enclose, protect and/or securely house the alarm unit 1309.

As shown in FIG. 13A, the mounting bracket 1306 may comprise, have and/or include the hooks 1035, the mounting hardware holes 1060, the mounting slots 1061 and/or a bracket body 1067. In embodiments, the bracket body 1067 may be made of a metal material and/or may have a depth that may be customizable and/or adjustable for a specific or pre-determined application, environment, surrounding shelves and/or fixtures. As shown in FIG. 13B, the mounting bracket 1306 may comprise, have and/or include the openings 1059, the mounting hardware holes 1060, the mounting slots 1061, one or more upright attachment brackets 1062 (hereinafter "upright brackets 1062") and/or a bracket body 1066. In embodiments, the upright brackets 1062 may have customizable or adjustable depths enabling the modular case 1300 to be located and/or positioned inline with surrounding shelves and/or fixtures. In embodiments, the bracket body 1066 may be made of a metal material and/or may have a depth that may be customizable and/or adjustable for a specific or pre-determined application, environment, surrounding shelves or fixtures In embodiments, the openings 1059 may be wire lead pass-through openings formed in at least one of the mounting brackets 1307, 1308 to allow for secure routing or positioning of an alarm sensor wire lead 1048. The mounting hardware holes 1060 may prevent vertical removal of one or more of the cases 1300 when connected, attached, secured, mounted and/or joined to the mounting bracket(s) by way of one or more case mounting tabs 1057 (hereinafter "mounting tabs 1057") provided on the mounting plate 1028 of the dispenser body 1010 and the mounting slots 1061 through the insertion and/or employment of third fasteners 1054 into mounting holes 1029. The mounting slots 1061 to accept, affix and/or join to the mounting tabs 1057 to connected, attach, secure, mount and/or join the case 1300 to one of the mounting brackets 1306, 1307, 1308. The lock holes 1068 may be pegboard lock holes which may prevent the mounting bracket 1308 from being removed from the fixtures 1040, 1400 without use of additional hardware (not shown in drawings). In an embodiment, the mounting tabs 1057 are located on the dispenser body 1010 and may slide or move into the case mounting slots 1061 of the mounting brackets 1306, 1307, 1308 such that the case 1300 is securely connected, mounted and/or attach to one of the mounting brackets 1306, 1307, 1308.

The floor 1030 of the case 1300 may have one or more holes 1064 located adjacent to or closer to the mounting plate 1028 of the case 1300. The holes 1064 in the floor 1030 may be aligned with the mounting hardware holes 1060 of the mounting bracket 1306, the mounting bracket 1307 or the mounting bracket 1308 and the third fasteners 1054 may be inserted therein to connect, attach, secure, mount or join the case 1300 with the mounting bracket 1306, the mounting bracket 1307 or the mounting bracket 1308. As a result, the case 1300 may be connected, attached, secured, mounted or joined to one the mounting brackets 1306, 1307, 1308 via the holes 1064 in the floor 1030, the mounting hardware holes 1060 and/or the third fasteners 1054. In embodiments, the third fasteners 1054 may be locking hardware for attachment through holes 1064 on the dispenser body 1010 and into attachment holes 1060 on the mounting brackets 1306, 1307, 1308. In an embodiment, the holes 1064 are locking holes formed in the dispenser body 1010 for secure attachment of the dispenser body 1010 to one of the mounting brackets 1306, 1307, 1308 via the third fastener 1054.

The dispenser body 1010 shown in FIG. 10 may comprise, have and/or include one or more of the same features and/or components of the dispenser body 1010 shown in FIGS. 3 and 4, and the dispenser body 1010 shown in FIG. 10 may function the same or substantially the same as the dispenser body 1010 shown in FIGS. 3, 4, 7A-7C and 8A-8C. In embodiments, the dispenser body 1010, shown in FIG. 10, may comprise, have and/or include one of the connection holes 127 on each side wall of the dispenser body 1010, and the connection holes may be located adjacent to or closer to the mounting plate 1028. The dispenser body 1010 may have at least two lower case cover the mounting holes 1063 (hereinafter "cover mounting holes 1063") that may be located on both side walls of the dispenser body 1010 and adjacent to or below the floor 1030 of the dispenser body 1010 as shown in FIGS. 10, 11 and 12A-12C.

The lower case cover 1056 may comprise, have and/or include at least two hardware mounting holes 1051 on two of side walls of the lower case cover 1056 and at least one wire guide 1053 on at least one of the side walls of the lower case cover 1056 as shown in FIG. 10. The lower case cover 1056 may be sized, shaped, configured and/or adapted to protect one or more alarm sensor and/or pusher components located in the lower case component housing 1305 below the floor 1030 of the dispensing body 1010 from being tampering with, disabled and/or damaged. In an embodiment, the lower case cover 1056 may be opaque in color such that the one or more alarm sensor and/or pusher components located in the lower case component housing 1305 are hidden from view or not visible to consumers. In embodiments, the hardware mounting holes 1051 of the lower case cover 1056 may be sized, shaped, configured and/or adapted to accept and/or receive the second fasteners 1052 such that the lower case cover 1056 may be connected, attached, secured, fastened and/or joined to the dispenser body 1010 via the second fasteners 1052, the hardware mounting holes 1051 of the lower case cover 1056 and the mounting holes 1063 of the dispenser body 1010. As a result, the lower case cover 1056 may be connected, attached, secured, fastened and/or joined to the dispenser body 1010 via the second fasteners 1052, the hardware mounting holes 1051 and/or the mounting holes 1063. In embodiments, the wire guide 1053 formed in lower case cover 1056 may be sized, shaped, configured and/or adapted to receive alarm sensor wire leads 1048 of the alarm tracking sensor 1065. As a result, the alarm sensor wire leads 1048 may pass from an interior of the lower case component housing 1305 to the surrounding environment via the wire guide 1053 of the lower case cover 1056.

The pusher paddle 1011 may be pushed or pulled forward towards the display window 1024 of the dispenser body 1010 via the paddle spring 1046 that is connected and/or attached to the pusher paddle 1011 as shown in FIG. 10. As a result, the products 1600, 1601, 1602 housed within the interior of the dispenser body 1010 may be push, pulled, forced or moved forward towards the display window 1024 via the pusher paddle 1011 and/or the paddle spring 1046.

The lock assembly 1302 shown in FIG. 10 may comprise, have and/or include the locking lid 1012, the front edge 1016, guide slots 1018, one mounting slot 1018 on each side wall of the locking lid 1012 and/or at least one lid positioning rail 1058 on each side wall of the locking lid 1012. The lid positioning rails 1058 may position, hold, secure and/or maintain the lid assembly 1302 in a horizontal position against or with respect to the dispenser body 1010. Further, the lid positioning rails 1058 may hold and/or maintain the lid assembly 1302 in a correct horizontal position when the lid assembly 1302 is being moved, adjusted, pushed, pulled and/or slid between the first, second and/or third positions via the first, second and/or third catches 1042, 1043, 1044, respectively.

Figure 11:
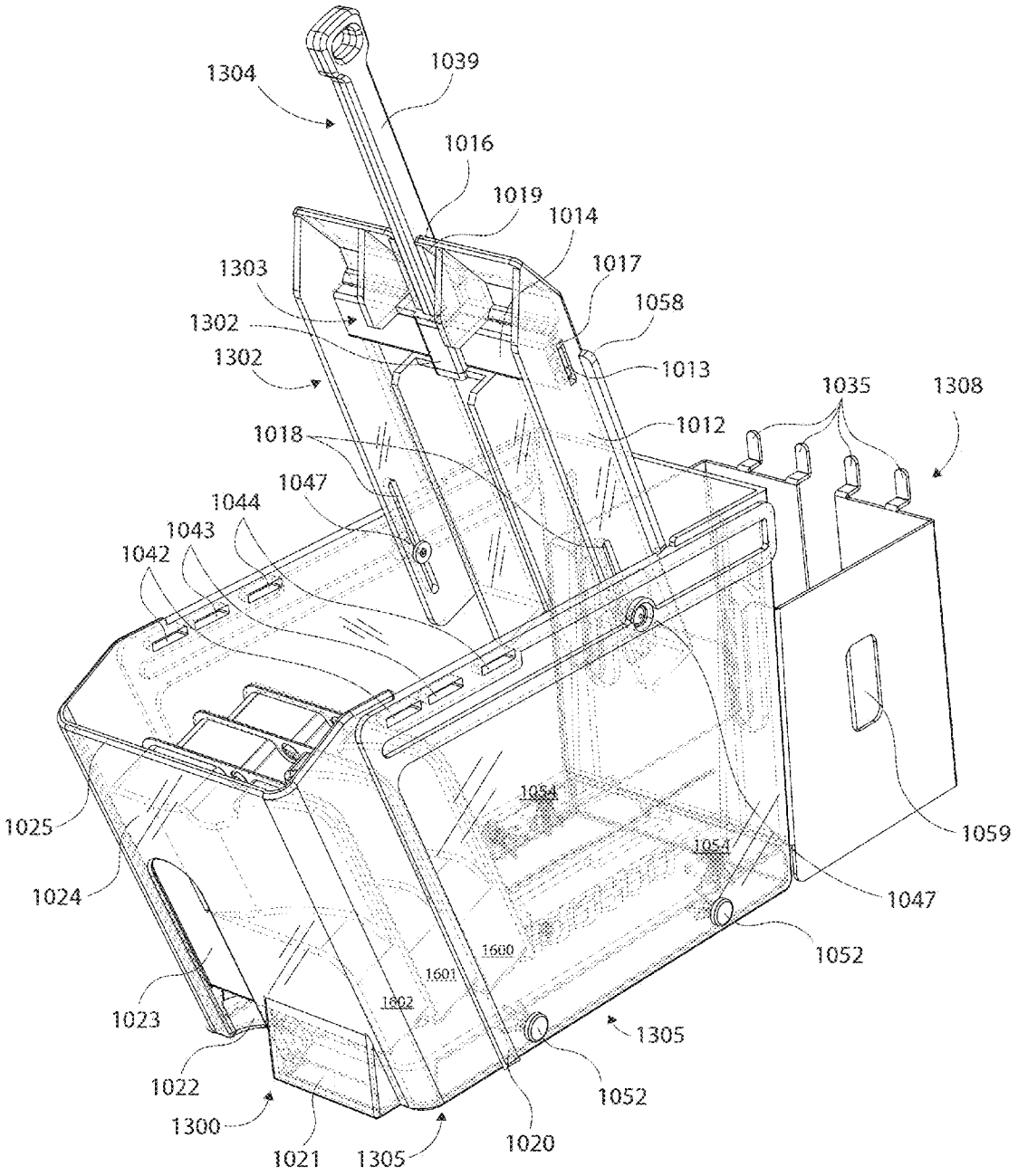
FIG. 11 illustrates a perspective view of the security case shown in FIG. 10 having a lid assembly located in an opened or unlocked position in an embodiment.

The first fasteners 1047 may be inserted into the connection holes 1027 of the dispenser body 1010 and the mounting slots 1018 of the locking lid 1012 as shown in FIGS. 10 and 11. As a result, the lock assembly 1302 may be connected, attached, secured, fastened and/or joined to the dispenser body 1010 via the first fasteners 1047, the connection holes 1027, the locking lid 1012 and/or the mounting slots 1018. Connecting the lid assembly 1302 to the dispenser body 1010 with one first fastener 1047 on each side allows the lock assembly to be opened by pivoting or rotating the front edge 1016 of the locking lid 1012 around the first fasteners 1047 as shown in FIG. 11. Access to the interior of the dispensing body 1010 for reloading, replacing and/or removing the products 1600, 1601, 1602 may be accomplished or achieved by unlocking the lock assembly 1303 with the release key 1304 and moving or rotating the front edge 1016 of the locking lid 1012 away from the removal lip 1025 of the dispenser body 1010. In an embodiment, the first fasteners 1047 may be hinge pins to enable slide and pivot functions of locking lid 1012 whereby the hinge pins connect and/or attach through the connection holes 1027 on the dispenser body 1010 and the mounting slots 1018 of the locking lid 1012

The lower case component housing 1305 may receive, contain, house, store, protect and/or secure the alarm sensor wire leads 1048 of the alarm sensor body 1065, at least one roller arm 1049 of the alarm sensor body 1065, the alarm sensor body 1065 and/or the sensor mounting bracket 1050 as shown in FIG. 10. In embodiments, wire leads 1048 may be electrically connected and/or attached and/or electrically in communication with a central alarm unit (not show in drawings), the roller arm 1049 may be configured and/or adapted to move along or follow a profile of the contact track 1032 which may activate the alarm sensor body 1065 when, for example, the pusher paddle 1011 and/or the paddle spring 1046 may move forwards or backwards with respect to the display window 1024 and/or the mounting plate 1028 of the dispenser body 1010. In an embodiment, the profile of the contact track 1032 may be in the form of an undulating wave creating a surface capable of activating and deactivating the roller arm 1049 by way of the alarm sensor body 1065. The sensor mounting bracket 1050 connects, attaches, secures, fastens and/or joins the alarm sensor body 1065 to the underside of pusher paddle 1011 and/or the paddle spring 1046.

FIG. 11 illustrates an opening/closing function of the lock assembly 1303 and the lid assembly 1302 wherein lock assembly 1303 is unlocked with the release key 1304 and the lid assembly 1302 is moved, rotated or pivoted into the open position such that the interior of the dispenser body 1010 is accessible from the surrounding environment. The lid assembly 1302 may be positioned and/or located in the open position for purposes of, for example, connecting and securing or detaching and removing the dispenser body 1010 to and/or from the mounting brackets 1308, 1307, 1306, and/or loading or unloading the products 1600, 1601, 1602 from the dispenser body 1010. In embodiment, vertical movement of lid assembly 1302 may be restricted, substantially restricted and/or prevented as a result of additional cases 1300 or other merchandising fixtures being located, placed and/or affixed above the locking lid 1302 (as shown in FIGS. 1, 9 and 14).

FIG. 11 shows the release key 1304 inserted into a key hole 1055 by way of the positioning guide 1019 of the locking lid 1012. As a result, the lock latches 1013 may be drawn, moved, pushed and/or pulled inwards (as described in FIGS. 6A and 6B) such that the forward or front portion of the lid assembly 1302 is released or detached from the forward or front portion of the dispenser body 1010. The lid assembly 1302 is free to move, rotate and/or pivot in an upward arc on the first fasteners 1047 through the mounting slots 1018 of the locking lid 1012. While in the open or vertical position, the lid assembly 1302 may be positioned, located and/or rested on back edges of the lid positioning rails 1058 against the dispenser body 1010. In embodiments, the mounting bracket locking holes 1054 of the dispenser body 1010 may be accessible for installation or removal when mounting or dismounting dispenser body 1010 from mounting bracket 1308 while the lid assembly 1302 may be located or positioned in the open or vertical position. In an embodiment, the lock containment body 1014 may comprise the key hole 1055.

Figure 12A:
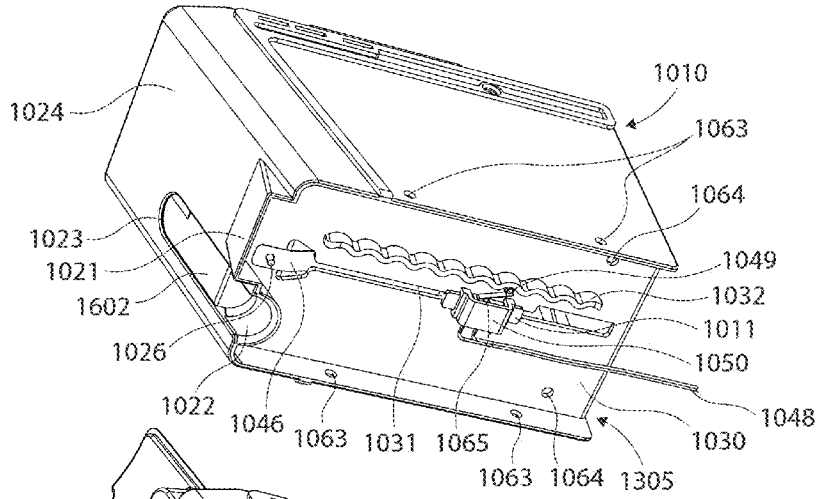
FIGS. 12A-12C illustrate perspective views of the underside of the security case shown in FIGS. 10 and 11 having an alarm sensor located in first, second and third positions, respectively, during retail product removal in an embodiment.
Figure 12B:
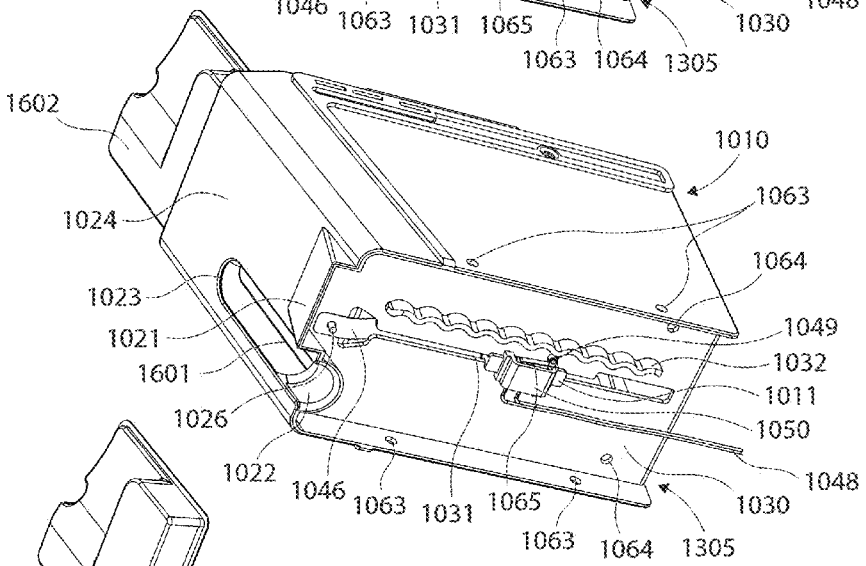
Figure 12C:
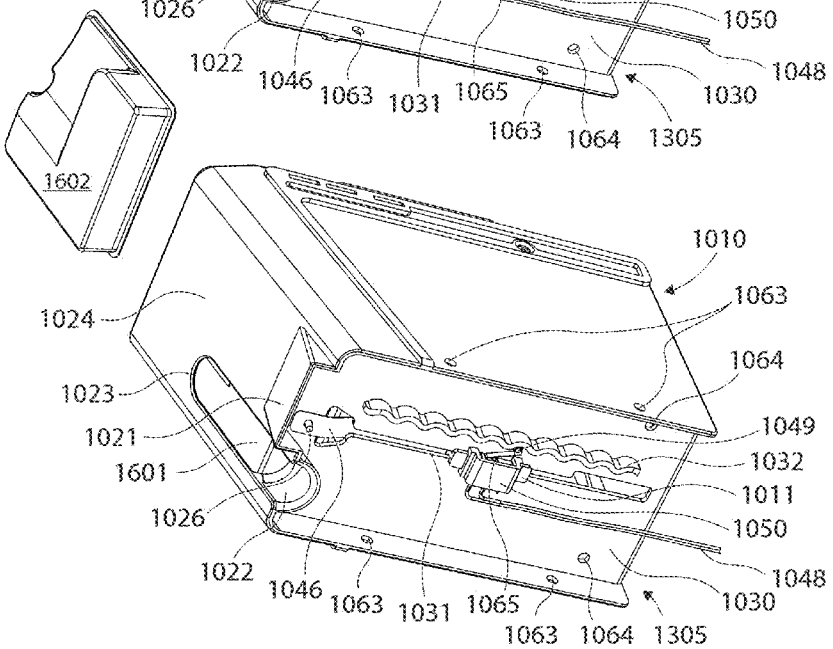

FIGS. 12A-12C illustrates an activation process of the alarm sensor body 1065 during a product removal process whereby the leading or third product 1602 is removed or dispensed from the dispenser body 1010. FIG. 12A shows the underside of the dispenser body 1010 and the lower case component housing 1035, whereby the pusher paddle 1011 is positioned rearward within the pusher paddle guide track 1031 as a result of the products 1602, 1601, 1600 being loaded within the interior of the dispenser body 1010 (product 1600, 1601 are not visible in FIGS. 12A-12C). The products 1602, 1601, 1600 are held under tension or force between the display window 1024 and the paddle 1011 as a result of forward linear pull force applied to the pusher paddle 1011 by the paddle spring 1046. Mounted to the underside of the pusher paddle 1011 is the alarm sensor body 1065 that may be secured in place with respect to the pusher paddle 1011 by the sensor mounting bracket 1050. A portion of the wire lead 1048 is shown attached to alarm sensor body 1065 and exiting the lower case component housing 1305. The sensor roller arm 1049 is in a released position determined by the location of the sensor roller arm 1049 within the sensor guide track 1032 which corresponds to the location of the pusher paddle 1011 within paddle guide track 1031 which is, in general, controlled by the number of retail products that are housed within the interior of the dispenser body 1010.

FIG. 12B shows the leading or third product 1602 within the dispenser case 1010 being removed by at least one finger 1801 of the user 1800 as described in FIGS. 8A-8C. As the leading or third product 1602 is being removed, the constant forward force being applied by the paddle spring 1046 begins to pull pusher paddle 1011 forward, moving the second product 1601 forward towards the display window 1024. As the pusher paddle 1011 moves parallel to sensor guide track 1032, the roller arm 1049 follows the contour or profile of the contact track 1032 and is moved, positioned and/or depressed to a closed or active position against the alarm sensor 1065 body which sends or transmits an electrical signal, via the wire lead 1048, to an alarm control unit 1309 (shown in FIG. 15). As a result, the alarm control unit may produce an alert, such as, for example, an audible alert, a visual alert, haptic alert and/or combinations thereof. The control alarm unit 1309 may be located locally or remotely with respect to the alarm sensor body 1065 and/or the dispenser body 1010. The control unit 1309 may be configured and/or adapted to track and store data, such as, for example, a number of retail products removed from one or more of the cases 1300. The alert may indicate that a single retail product or a plurality of retail products has been removed from one or more cases 1300. One or more employees within the vicinity of the one or more cases 1300 may monitor the number of retail products removed by at least one customer or at least one potential thief by identifying the number of alerts produced by the alarm control unit 1309. In an embodiment, the one or more employees may monitor the number of retail products removed by a customer or potential thief by listening to a number of chimes produced or played by the alarm control unit 1309.

FIG. 12C shows the leading or third product 1602 completely removed from dispenser body 1010 with the second product 1601 pushed forward against the display window 1024. During the process, the pusher paddle 1011 completes its forward movement releasing roller arm 1049 from the closed or active position into the open or depression position along the contact track 1032.

FIG. 13A shows the mounting bracket 1306 which may, in embodiments, be a multi-unit pegboard mounting bracket. In an embodiment, the mounting bracket 1306 may be sized, shaped, configured and/or adapted to mount up to five cases 1300 by connecting, attaching mounting and joining the bracket mounting tabs 1057 of the dispenser body 1010 to the mounting slots 1061 of the bracket body 1067. The dispenser body 1010 may be secured in place via inserting the third fasteners 1054 though the lock holes 1064 of the dispenser body 101 into the lock holes 1060 on the mounting bracket body 1067. In embodiments, the mounting bracket 1306 may be configured and/or adapted to mount and/or support at least two, but no more than ten, cases 1300.

FIG. 13B shows the mounting bracket 1307 which may, in embodiments, by a multi-unit upright mounting bracket. In an embodiment, the mounting bracket 1307 may be sized, shaped, configured and/or adapted to mount up to nine cases 1300 horizontally within the second fixture 1400, secured to the uprights 1045. The cases 1300 may be attached by way of inserting the bracket mounting tabs 1057 on the dispenser body 1010 into the mounting slots 1061 on the bracket body 1067. The dispenser body 1010 may be secured in place via inserting the third fasteners 1054 though the lock holes 1064 on the dispenser body 101 into the lock holes 1060 on the mounting bracket body 1067.

In embodiments, FIG. 14 shows three different mounting bracket options, namely, the first mounting bracket 1306, the second mounting bracket option 1307, and the third mounting bracket 1308. The second mounting bracket may be a multi-unit upright mounting bracket that may be affixed into the uprights 1045 and may include eight cases 1300 attached thereto. One case 1300 has been omitted from the second mounting bracket 1307 for visualization purposes of FIG. 14. The first mounting bracket 1306 may be a multi-unit pegboard bracket which may be mounted to the first fixture 1040 underneath the second mounting bracket 1307 and may include four cases 1300 attached thereto. One case 1300 has been omitted from the first mounting bracket 1306 for visualization purposes of FIG. 14. The lock release key 1304 may be inserted into the right most case 1300 mounted to the first mounting bracket 1306 which may be utilized for adjustment of the locking lid 1302 as outlined in FIGS. 7A-7C. The third mounting bracket 1308 may, in embodiments, be two Single modular pegboard brackets 1308 that are mounted to the first fixture 1040 underneath the first mounting bracket 1306.

FIG. 15 shows the alarm control unit 1309 which may comprise, have and/or include an audible alarm buzzer or speaker 1069 (hereinafter "speaker 1069") and a plurality of female sensor connectors 1071. In an embodiment shown in FIG. 15, the alarm control unit 1309 may have nine female sensor connectors 1071 as would be required to connect one row of nine cases units 1300 within the second fixture 1400 as seen in FIG. 14 or any mounting configuration of nine cases units 1300. However, the alarm control unit 1309 may have any number of female sensor connecters 1071. The alarm control unit 1309 may be sized, shaped, configured and/or adapted to fit and/or be secured within the first, second and/or third mounting bracket options 1306, 1307, 1308 as shown in FIG. 14. As shown in FIG. 15 a male connector 1070 may be locally or remotely connected to the wire lead 1048 of the alarm sensor body 1065 and may be sized, shaped, configured and/or adapted to be inserted into one of female sensor connectors 1071 of alarm control unit 1309 to electrically connect the alarm sensor body 1065 to the alarm control unit 1309. As a result, the alarm sensor body 1065 may be in electrical communication with the alarm control unit 1309 via the wire lead 1048, the male connector 1070 and/or one of the female sensors 1071. Moreover, the alarm sensor body 1065 may send or transmit one or more signal to the alarm control unit 1309 via the wire lead 1048, the male connector 1070 and/or one of the female sensors 1071, and the alarm control unit 1309 may receive one or more signals from the alarm body 1065 via the wire lead 1048, the male connector 1070 and/or one of the female sensors 1071. In an embodiment, the alarm control unit 1309 may be utilized to track the removal of one or more products 1600, 1601, 1602 from dispenser body 1010. The alarm control unit may produce or creates one or more alerts, such as an audio alert to signal or indicate that one or more of the products 1600, 1601, 1602 are being accessed and/or dispensed. In a preferred embodiment, a tone or a series of tones are produced or played for each product removed from any dispenser body 1010 of any case 1300 that is connected to the alarm control unit 1309.

In embodiments, the present systems and methods utilizing at least one case 1300 may: provide a small, compact and modular system for securely dispensing one or more of the products 1600, 1601, 1602; allow for one or more of the products 1600, 1601, 1602 to be returned into the case 1300 if no longer desired; solve issues with unwanted packages littering store shelves and being vulnerable to theft; not require the width of a full 48 foot store section for installation; allow the number of product facings to be selected and positioned within the store environment however the retailer sees fit; allow the present cases to take advantage of the flexibility of pegboard while still utilizing secure mounting methods; solve product visibility issues and/or may eliminate the need for paper item labels; allow for an unobstructed view of the sample product; accommodate a full range of package sizes both for dispensing and within the display window area, unlike known dispensing systems and methods; not require a traditional key which are often difficult to replace; utilize a custom designed lock for saving space; provide a plurality of small cases 1300, affixable to pegboard, that may be arranged in any combination of rows and/or columns or may be utilized as individual display cases; not use complicated mechanical mechanisms for dispensing product resulting in lesser chances or opportunities for breakage of and/or tampering with the products 1600, 1601, 1602; and/or provide the vertical product lift slot which may be simple, intuitive and/or may not require detailed instruction on how to use lift slot.

It will be appreciated that various of the above-disclosed and other features and functions, or alternatives thereof, may be desirably combined into many other different systems and/or methods. Also, various presently unforeseen or unanticipated alternatives, modifications, variations or improvements therein may be subsequently made by those skilled in the art, and are also intended to be encompassed by the present disclosure.

We claim:

1. A modular manual lift dispenser security system for storing and dispensing at least one retail product, the system comprising:

a dispenser body having a floor and walls extending above the floor, wherein the walls comprise a front wall and a back wall facing each other and at least two side walls facing each other, wherein the walls of the dispenser body define an interior of the dispenser body that is sized or shaped to receive one or more retail products, and further wherein the front wall extends from the floor at an angle away from the back wall;

a pusher paddle located within the interior of the dispenser body, wherein the pusher paddle is spring-loaded and configured to move one or more retail products towards the front wall of the dispenser body when the one or more retail products are positioned within the interior of the dispenser body;

a locking lid assembly at least connected to a top edge of each side wall of the dispenser body via at least one fastener, wherein the top edge of each side wall is located opposite with respect to the floor of the dispenser body, wherein the locking lid assembly is slidable from a first position to at least one second position; and a lock assembly provided within the locking lid assembly, wherein the locking lid assembly is slidable from the first position to the second position when the lock assembly is unlocked and further wherein the locking lid assembly is stationary in the first position or second position when the lock assembly is locked, wherein access to the interior of the dispenser body is prevented when the locking lid assembly is located in the first position, wherein a first opening is provided between a lip of the front wall of the dispenser body and the front edge of the locking lid assembly when the locking lid assembly is located in the second position, wherein the lip of the front wall is located opposite with respect to the floor of the dispenser, and further wherein the first opening is sized such that a leading retail product, adjacent to the front wall of the dispenser body, is passable through the first opening between the lip of the front wall and the front edge of the locking lid assembly from the interior of the dispenser body to an exterior environment when at least the retail product is positioned within the interior of the dispenser body, and further wherein the lock assembly comprises slidable lock latches and springs that force the slidable lock latches outward with respect to side walls of the lock assembly through slots formed in the side walls of the lock assembly.

2. The system according to claim 1, further comprising:

a release key for unlocking the lock assembly, wherein release key is at least one of sized and shaped to be inserted into a positioning guide formed on a top surface of the locking lid assembly for unlocking the lock assembly, wherein the top surface of the locking lid is located opposite with respect to the lock assembly.

3. The system according to claim 2, wherein the lock assembly is a magnetic spring lock assembly and the release key comprises a magnet.

4. The system according to claim 1, wherein the lock latches extend through the slots of the lock assembly and into catches formed in the side walls of the dispenser body when the lock assembly is locked, and further wherein the lock latches only extend through the slots of the lock assembly when the lock assembly is unlocked.

5. The system according to claim 1, wherein the entire length of the lock latches are positioned within the lock assembly when a release key, comprising a magnet, is positioned on a top surface of the lock assembly between the side walls of the lock assembly.

6. The system according to claim 1, wherein a front surface of the pusher paddle located adjacent to the front wall of the dispenser body is angled forward towards the front wall and away from the back wall of the dispenser body.

7. A modular manual lift dispenser security system for storing and dispensing at least one retail product, the system comprising:

a dispenser body having a floor and walls extending above and below the floor, wherein the walls comprise a front wall and a back wall facing each other and at least two side walls facing each other, wherein the walls of the dispenser body define an interior of the dispenser body that is sized or shaped to receive one or more retail products;

a locking lid assembly slidably connected to a top edge of each side wall of the dispenser body via at least one fastener, wherein the top edge of each side wall is located opposite with respect to the floor of the dispenser body;

a pusher paddle located within the interior of the dispenser body, wherein the pusher paddle is spring-loaded and configured to move one or more retail products towards the front wall of the dispenser body when the one or more retail products are positioned within the interior of the dispenser body;

an alarm sensor body, having a roller arm, connected to the pusher paddle and located within a housing below the floor of the dispenser body, wherein the housing below the floor is defined by the walls extending below the floor of the dispenser body, wherein movement of the pusher paddle activates the alarm sensor body and an alert is produced.

8. The system according to claim 7, the system further comprising:

a cover connected to the housing such that the alarm sensor is enclosed between the floor, the housing and the cover.

9. The system according to claim 7, the system further comprising:

a contact track provided below the floor of the dispenser body and extending between at least a portion of the length of the dispenser body defined between the front wall and back wall of the dispenser body, wherein the alarm sensor body is movable along a profile of the contact track.

10. The system according to claim 9, wherein the roller arm contacts the contact track and follows the profile of the contact track as the alarm sensor body and pusher paddle move along the length of the dispenser body.

11. The system according to claim 9, wherein the profile of the contact track is an undulating wave.

* * * * *